US008176861B2

(12) United States Patent
Hayakawa et al.

(10) Patent No.: US 8,176,861 B2
(45) Date of Patent: May 15, 2012

(54) EMBROIDERY DATA PROCESSOR, SEWING MACHINE, AND COMPUTER READABLE MEDIUM FOR EMBROIDERY DATA PROCESSING

(75) Inventors: Atsuya Hayakawa, Chita (JP); Nobuaki Matsumoto, Nagoya (JP); Kenji Ooka, Hekinan (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 1090 days.

(21) Appl. No.: 12/076,747

(22) Filed: Mar. 21, 2008

(65) Prior Publication Data

US 2008/0264319 A1 Oct. 30, 2008

(30) Foreign Application Priority Data

Mar. 23, 2007 (JP) ..... 2007-077038
Feb. 4, 2008 (JP) ..... 2008-023969

(51) Int. Cl.
*D05B 19/00* (2006.01)

(52) U.S. Cl. ..... 112/470.01

(58) Field of Classification Search ..... 112/470.01, 112/470.02, 470.04, 470.05, 470.06, 470.09
See application file for complete search history.

(56) References Cited

U.S. PATENT DOCUMENTS 4,849,902 A * 7/1989 Yokoe et al. ..... 112/470.04

FOREIGN PATENT DOCUMENTS

| | | |
|---|---|---|
| JP | A-50-132262 | 10/1975 |
| JP | U-02-102494 | 8/1990 |
| JP | A-06-101159 | 4/1994 |
| JP | A-06-205885 | 7/1994 |

* cited by examiner

*Primary Examiner* — Tejash Patel
(74) *Attorney, Agent, or Firm* — Oliff & Berridge, PLC

(57) ABSTRACT

An embroidery data processor includes an embroidery data storage that stores embroidery data for sewing embroidery patterns by an embroiderable sewing machine; an embroidery data preparator that prepares the embroidery data of the embroidery patterns to be sewn by reading the embroidery data from the embroidery data storage or by receiving the embroidery data from external source; and a data generator that generates temporary stitch data for temporarily sewing an interlining on an underside of a workpiece cloth prior to embroidery sewing based on the embroidery data prepared by the embroidery data preparator.

18 Claims, 28 Drawing Sheets

EMBROIDERY DATA PROCESSOR, SEWING MACHINE, AND COMPUTER READABLE MEDIUM FOR EMBROIDERY DATA PROCESSING

CROSS-REFERENCE TO RELATED APPLICATION

This application is based upon and claims the benefit of priority from the prior Japanese Patent Application 2007-077038, filed on Mar. 23, 2007 and 2008-023969, filed on Feb. 4, 2008, the entire contents of which are incorporated herein by reference.

FIELD

The present disclosure relates to the art of embroidery sewing, and more specifically to embroidery sewing carried out by temporarily sewing an interlining on the underside of a workpiece cloth prior to execution of embroidery sewing to prevent gathering of the workpiece cloth when embroidery patterns are sewn.

BACKGROUND

In the field of embroidery sewing machines, a typical problem encountered in sewing embroidery patterns on a workpiece cloth seized by an embroidery frame is gathering of workpiece cloth. Gathering occurs depending on the type of workpiece cloth used and the type of embroidery pattern sewn, and undesirably results in poor quality embroidery patterns. This is particularly noticeable in cases where a pattern is initially sewn with fill stitches, also known as tatami stitches, and thereafter outlined with run stitches, in which case the workpiece cloth tends to gather toward the direction in which the fill stitches are formed. This causes unwanted space to be created between the fill stitches and the outline, resulting in poor look and feel of the embroidery. One conventional solution to such problem is to thermally adhere an interlining coated with thermal adhesives like hot melt on the underside of the workpiece cloth to prevent gathering and puckering of the workpiece cloth.

For example, JP H06-101159 A (hereinafter referred to as patent document 1) discloses, as can be seen typically in pages 2 to 3 and FIG. 1, a method of embroidery processing in which a support is provided for reinforcement of stretch fabric and thin, pucker-prone fabric. The reference exemplifies such support with a film having an adhesive coating on one side which is superimposed on the underside of a fabric. The fabric and the film are thereafter adhered together with an electric iron or electric solder to form an integrated workpiece. Then, the workpiece is secured on the embroidery frame to execute embroidery sewing. The fabric being integral with the film is given reinforced rigidity, and thus, local fabric puckering originating from tensioning of embroidery seams can be prevented.

The embroidery processing method described in patent document 1 requires a preparatory step prior to embroidery sewing in which the fabric and the film are superimposed and integrated by way of thermal adhesion effected by the heat applied by electric iron or electric solder. Thus, time expended on adhesion will increase proportionate to the size of the embroidery pattern and pose increased complexity in the preparatory step, which in turn leads to problems such as poor overall work efficiency.

SUMMARY

An object of the present disclosure is to facilitate and quicken the integration of interlining and workpiece cloth for preventing the gathering of workpiece cloth.

According to a first exemplary embodiment, an embroidery data processor includes an embroidery data storage that stores embroidery data for sewing embroidery patterns by an embroiderable sewing machine; an embroidery data preparator that prepares the embroidery data of the embroidery patterns to be sewn by reading the embroidery data from the embroidery data storage or by receiving the embroidery data from external source; and a data generator that generates temporary stitch data for temporarily sewing an interlining on an underside of a workpiece cloth prior to embroidery sewing based on the embroidery data prepared by the embroidery data preparator.

As a preparatory step for sewing embroidery patterns with the embroiderable sewing machine, temporary stitch data is generated based on the embroidery data prepared by the embroidery data preparator. Interlining is applied on the underside of the workpiece cloth and set on the embroidery frame by the user. Then, the interlining is temporarily sewn on the underside of the workpiece cloth based on the temporary stitch data prior to execution of embroidery sewing.

The embroidery data processor allows the interlining to be sewn on the underside of the workpiece cloth by using the temporary stitch data generated based on the embroidery data used for embroidering. Thus, adhesion of interlining on the underside of the workpiece cloth with an electric iron or electric solder can be eliminated completely and the object of preventing gathering and providing reinforcing support to the workpiece cloth can be achieved by easy and quick integration of the workpiece cloth and the interlining. Further, the interlining can be readily removed by cutting off the temporary stitches after sewing of embroidery patterns have been completed.

According to a second exemplary embodiment, a sewing machine includes an embroidery data storage that stores embroidery data for sewing embroidery patterns by an embroiderable sewing machine; an embroidery data preparator that prepares the embroidery data of the embroidery patterns to be sewn by reading the embroidery data from the embroidery data storage or by receiving the embroidery data from external source; and a data generator that generates temporary stitch data for temporarily sewing an interlining on an underside of a workpiece cloth prior to embroidery sewing based on the embroidery data prepared by the embroidery data preparator.

The above described sewing machine also provides the operation and effects of the first exemplary embodiment.

According to a third exemplary embodiment, a computer readable medium for embroidery data processing includes a computer program including an embroidery data preparing routine of preparing embroidery data of embroidery patterns to be sewn by an embroiderable sewing machine by reading the embroidery data from an embroidery data storage or by receiving the embroidery data from external source; and a data generating routine of generating temporary stitch data for temporarily sewing an interlining on an underside of a workpiece cloth prior to embroidery sewing based on the embroidery data prepared by the embroidery data preparing routine.

The computer readable medium for embroidery data processing allows the program stored in it to be read and executed by a computer to provide the operation and effects of the first exemplary embodiment.

BRIEF DESCRIPTION OF THE DRAWINGS

Other objects, features and advantages of the present disclosure will become clear upon reviewing the following description of the illustrative aspects with reference to the accompanying drawings, in which.

DETAILED DESCRIPTION

The embroidery data processor of the present disclosure automatically generates temporary stitch data such as "outlines" and "geometrical figures" based on embroidery data of the embroidery pattern to be sewn as a preparatory step prior to sewing the embroidery pattern on a workpiece cloth.

Figure 1:
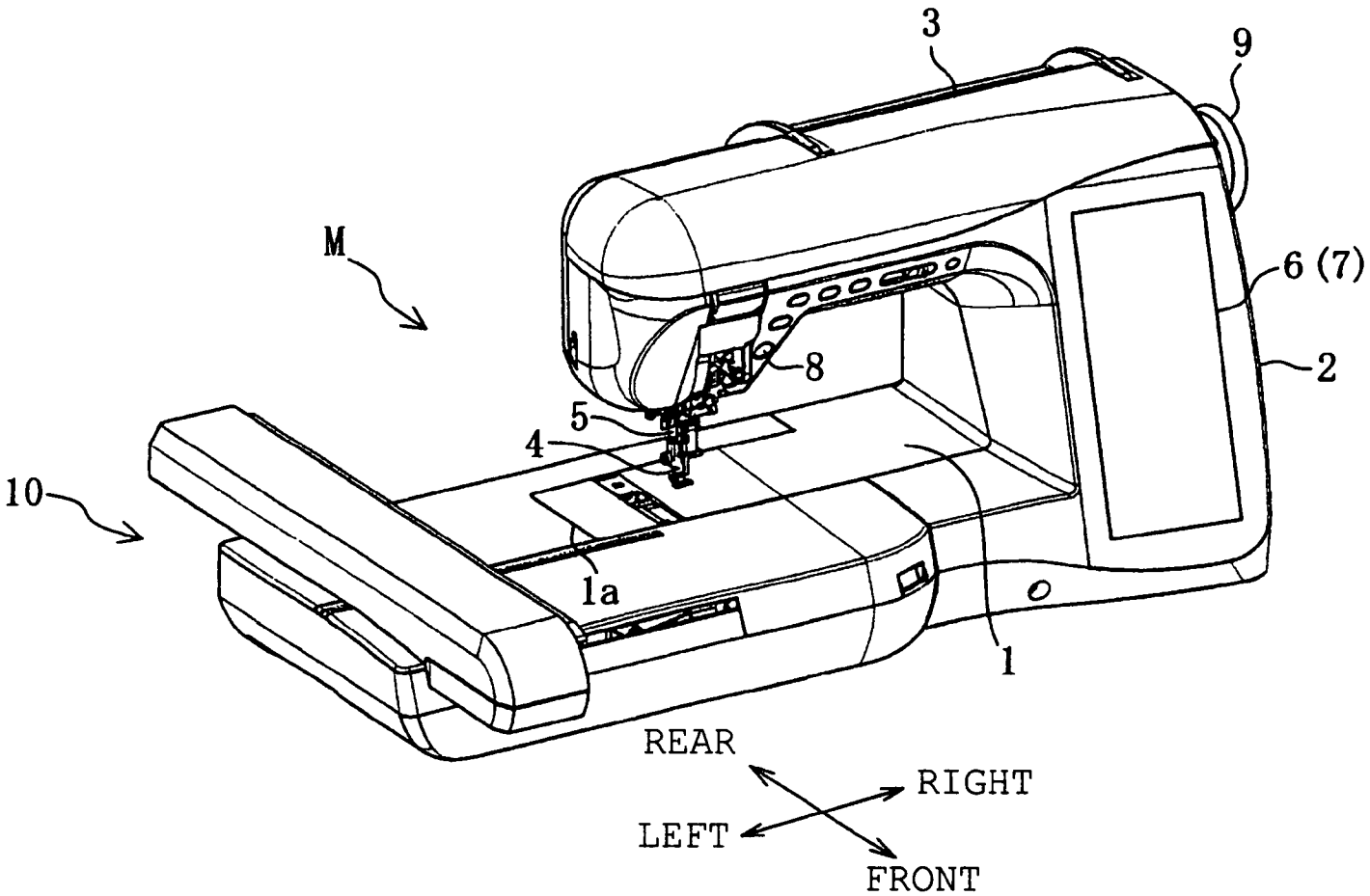
FIG. 1 is a perspective view of a sewing machine according to one illustrative aspect of the present disclosure.

Referring to FIG. 1, an embroiderable sewing machine M includes, a bed 1, a pillar 2 standing on the right end of the bed 1, and an arm 3 extending leftward over the bed 1 from the upper end of the pillar 2. Provided below a needle plate 1*a* placed on the bed 1 are components such as a feed dog vertically moving mechanism (not shown), a feed dog longitudinally moving mechanism (not shown), a hook mechanism (not shown), an automatic thread cutting mechanism (not shown). The feed dog vertically moving mechanism vertically moves a feed dog (not shown), whereas the feed dog longitudinally moving mechanism longitudinally feeds the feed dog. The hook mechanism attachably/detachably receives the bobbin thread bobbin (not shown). The automatic thread cutting mechanism cuts at least a needle thread.

An embroidery frame drive mechanism 10 for sewing embroidery by use of embroidery frame WK (refer to FIG. 24) is provided in the free arm of the bed 1. The embroidery frame drive mechanism 10 is configured to be attachable to/detachable from the free arm. The embroidery frame drive mechanism 10 includes an X-directional drive mechanism, an X-directional drive motor 17 (refer to FIG. 2), a Y-directional drive mechanism, a Y-directional motor (refer to FIG. 2) and other components. The X-directional drive mechanism and the X-directional drive motor 17 transfer the embroidery frame WK in the X-direction (lateral direction). The Y-directional drive mechanism and the Y-directional drive motor 19 transfer the embroidery frame WK in the Y-direction (longitudinal direction). A large-type color liquid crystal display 6 (hereinafter referred to as LCD 6) is provided in the front face of the pillar 2. The LCD 6 displays screens such as a menu screen, a pattern group selection screen, and pattern selection screen.

A touch panel 7 for user operation is provided in the front face of the LCD 6. The touch panel 7 is composed of a plurality of touch keys constituted by transparent poles in matrix alignment. In selecting a pattern or instructing execution of a sewing function, the user is allowed to select the desired pattern from a plurality of sewing patterns or instruct execution of the desired sewing function displayed on the LCD 6 by pressing the corresponding touch keys 7*a* to 7*g* (refer to FIGS. 18 to 22) either manually or by a touch pen (not shown).

Provided in the arm 3 are components such as a main shaft (not shown), a hand pulley 9, a needle-bar drive mechanism (not shown), and a needle-bar swing mechanism (not shown). The laterally extending main shaft is rotated by a sewing machine motor 13 (refer to FIG. 2). The hand pulley 9 allows manual rotation of the main shaft. The needle-bar drive mechanism having a sewing needle 4 attached to its lower end vertically reciprocates a needle bar 5. The needle-bar swing mechanism swings the needle bar 5 in a direction orthogonal to the direction of cloth feed. Various switches such as a sewing start/stop switch 8 are provided on the front face of the arm 3. The start/stop switch 8 instructs starting/stopping of a sewing operation.

Figure 2:
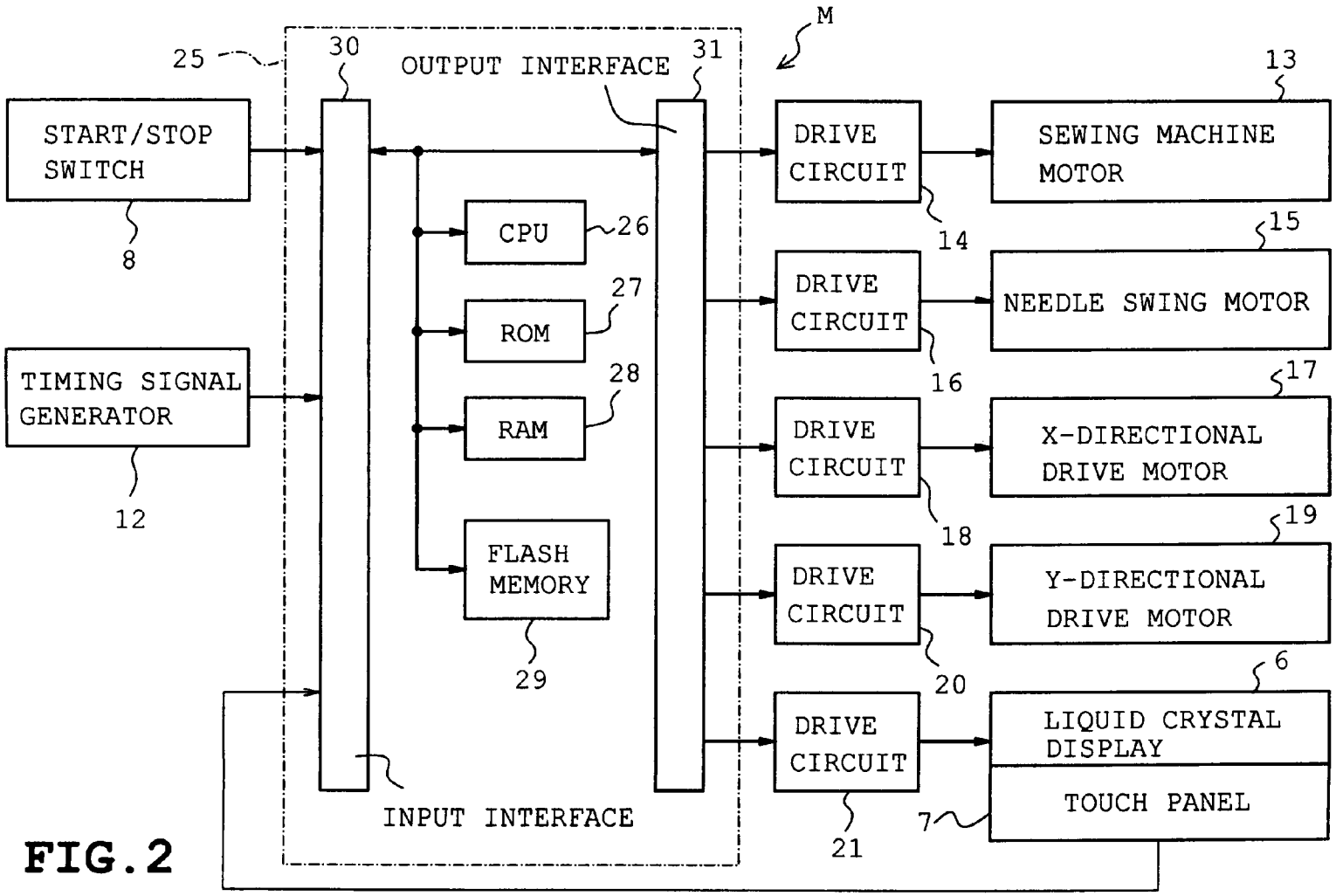
FIG. 2 is a block diagram of a control system of the sewing machine.

Next, a description will be given on the control system of the embroiderable sewing machine M. Referring to FIG. 2, a controller 25 is configured by components such as a microcomputer, an input interface 30, and an output interface 31. The microcomputer includes a CPU 26, a ROM 27, a RAM 28 and a programmable non-volatile flash memory 29. The input interface 30 and output interface 31 are connected to the microcomputer via data bus, or the like.

Connected to the input interface 30 are components such as the start/stop switch 8, a timing signal generator 12 for detecting the rotational position of the main shaft, and the touch panel 7. On the other hand, the output interface 31 establishes electrical connection with drive circuits 14, 16, 18, 20 and 21 for a sewing machine motor 13, a needle swing motor 15, the X-direction drive motor 17, the Y-directional drive motor 19, and the LCD 6, respectively.

Programs such as a control program for sewing utility patterns, a control program for sewing embroidery patterns based on embroidery data, a display control program for displaying various information of the LCD 6, a pattern selection control program for selecting a given sewing pattern from a plurality of sewing patterns displayed on the LCD 6, and a control program for a later described temporary stitch data generating control are preinstalled in the ROM 27.

Embroidery data for a plurality of sewing patterns are pre-stored in the flash memory 29. Upon execution of sewing process by the sewing machine M, the embroidery data of the selected sewing pattern is read from the flash memory 29 and stored in a data memory of the RAM 28. The RAM 28 includes the data memory and various work memory. Data memory stores embroidery data for execution of sewing operation read from the flash memory 29.

Figure 3:
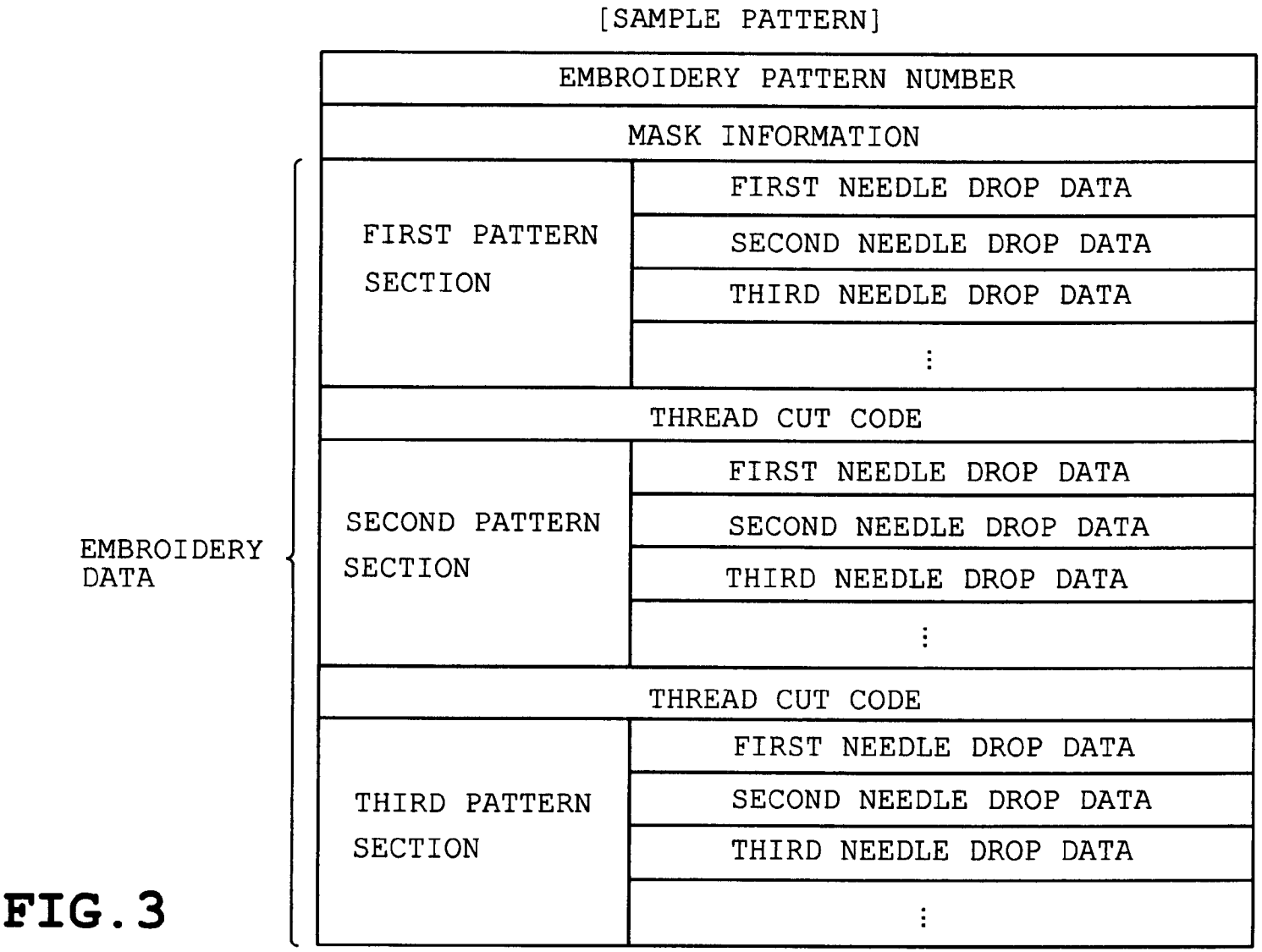
FIG. 3 describes a data configuration of embroidery data.
Figure 4:
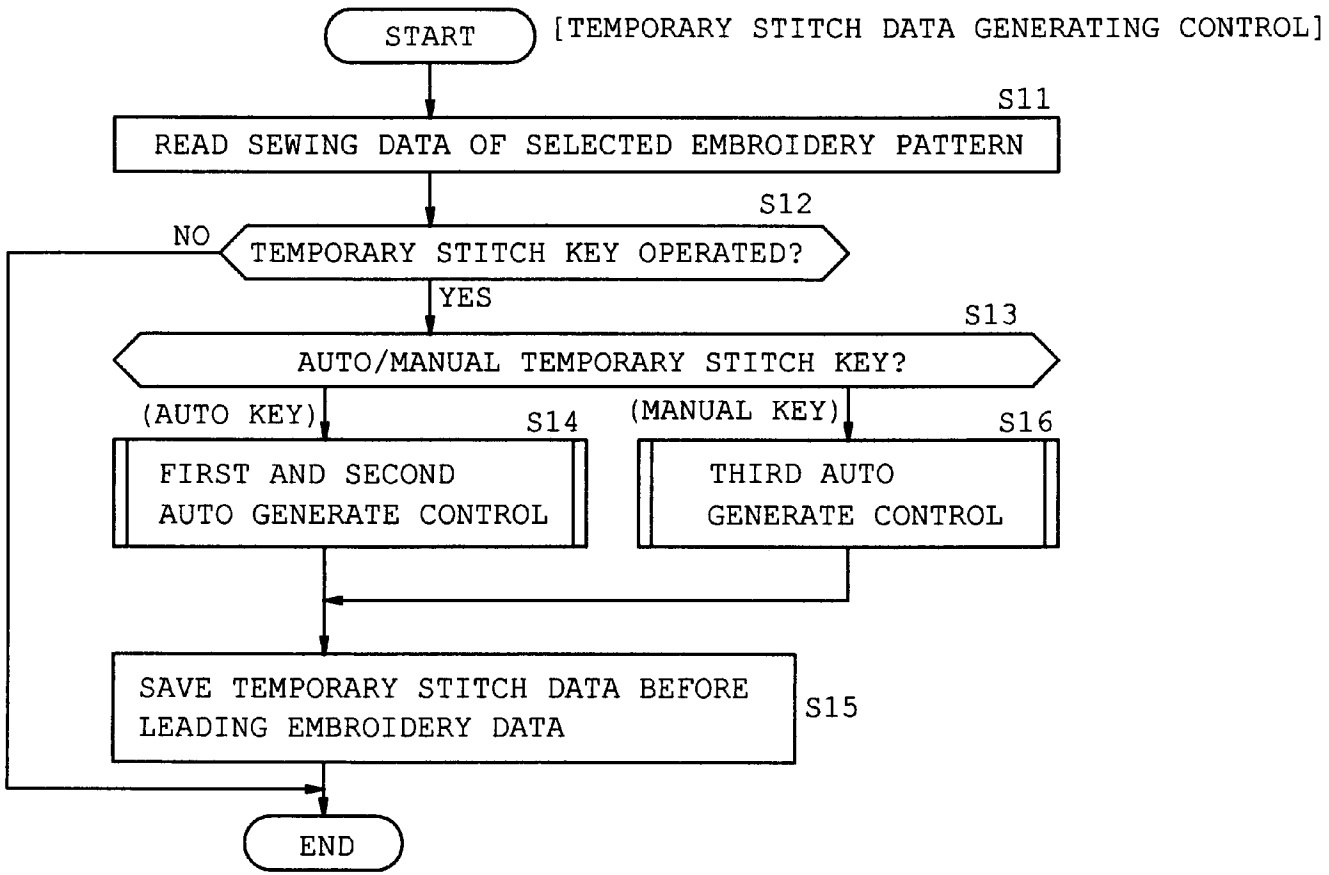
FIG. 4 is a flowchart of a temporary stitch data generating control.
Figure 5:
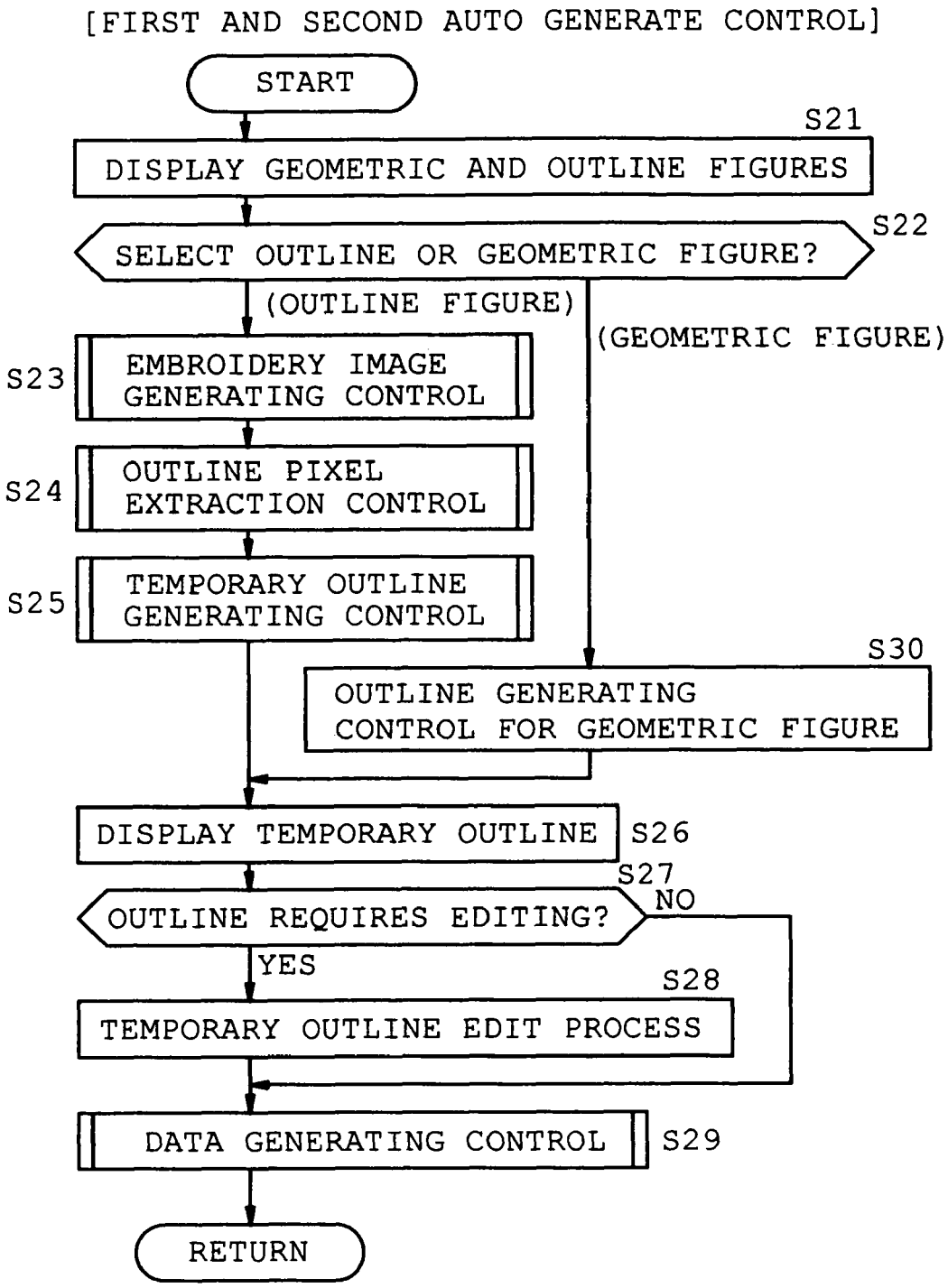
FIG. 5 is a flowchart of a first and second auto generate control.
Figure 6:
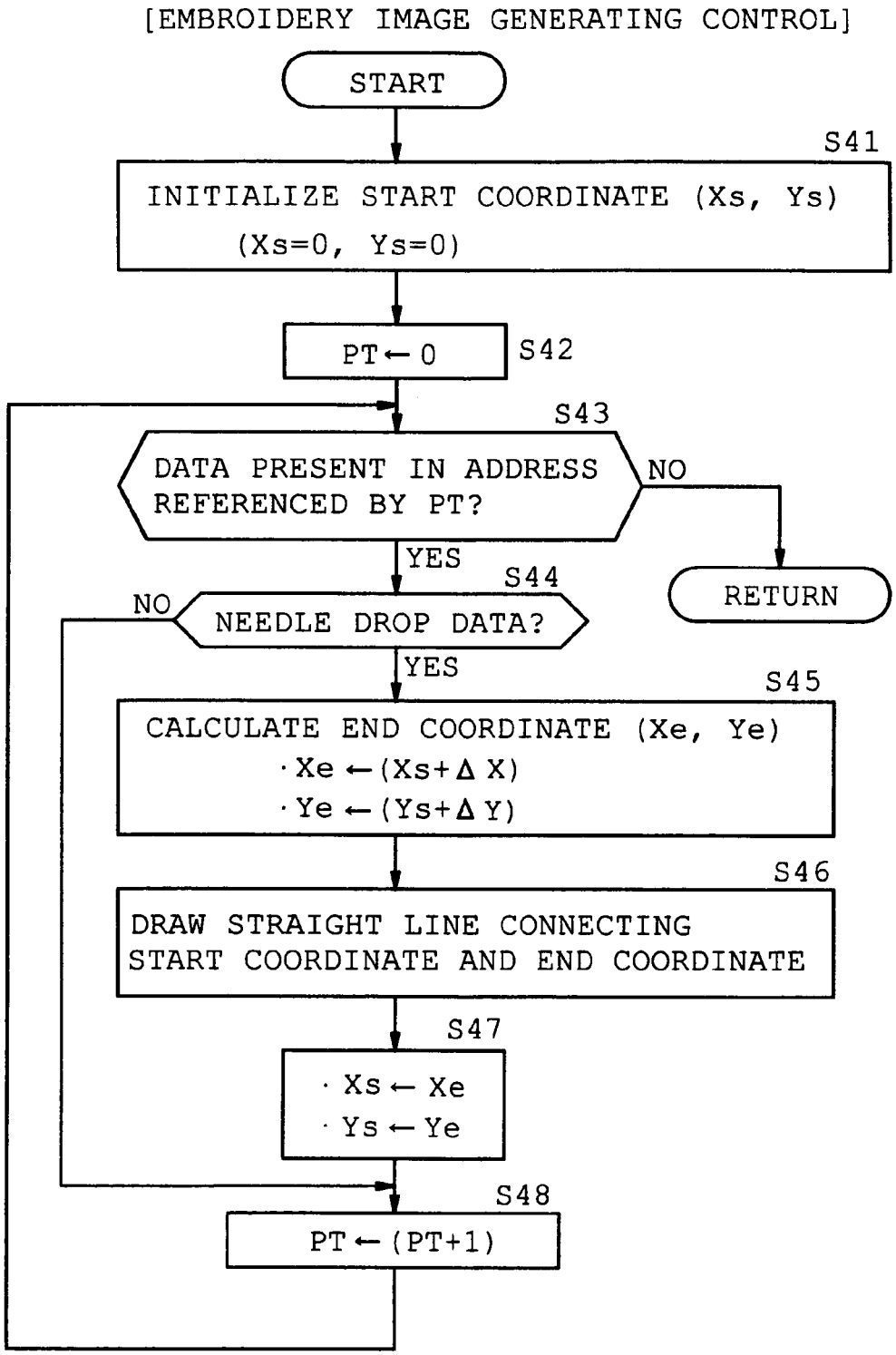
FIG. 6 is a flowchart of an embroidery image generating control.

Data configuration of the embroidery data will be described hereinafter by way of example. The embroidery data of a sample pattern SM (configured by three embroidery areas) shown in FIG. 3 stores "embroidery pattern number", "mask information", and "needle drop data" for each of the three embroidery sections comprising "first embroidery section M1" to "third embroidery section M3" that constitute the sample pattern SM. The needle drop data indicates relative movement amount (movement amount of embroidery frame Wk) from the previous needle drop position to the current needle drop position. The Mask information contains size information of a rectangular frame surrounding the outer periphery of the sample pattern SM.

Next, the flowchart of temporary stitch data generating control executed by the control unit 25 will be described based on FIGS. 4 to 12. The reference symbol Si (i=11, 12 . . . ) indicates each step of the control flow.

Figure 18:
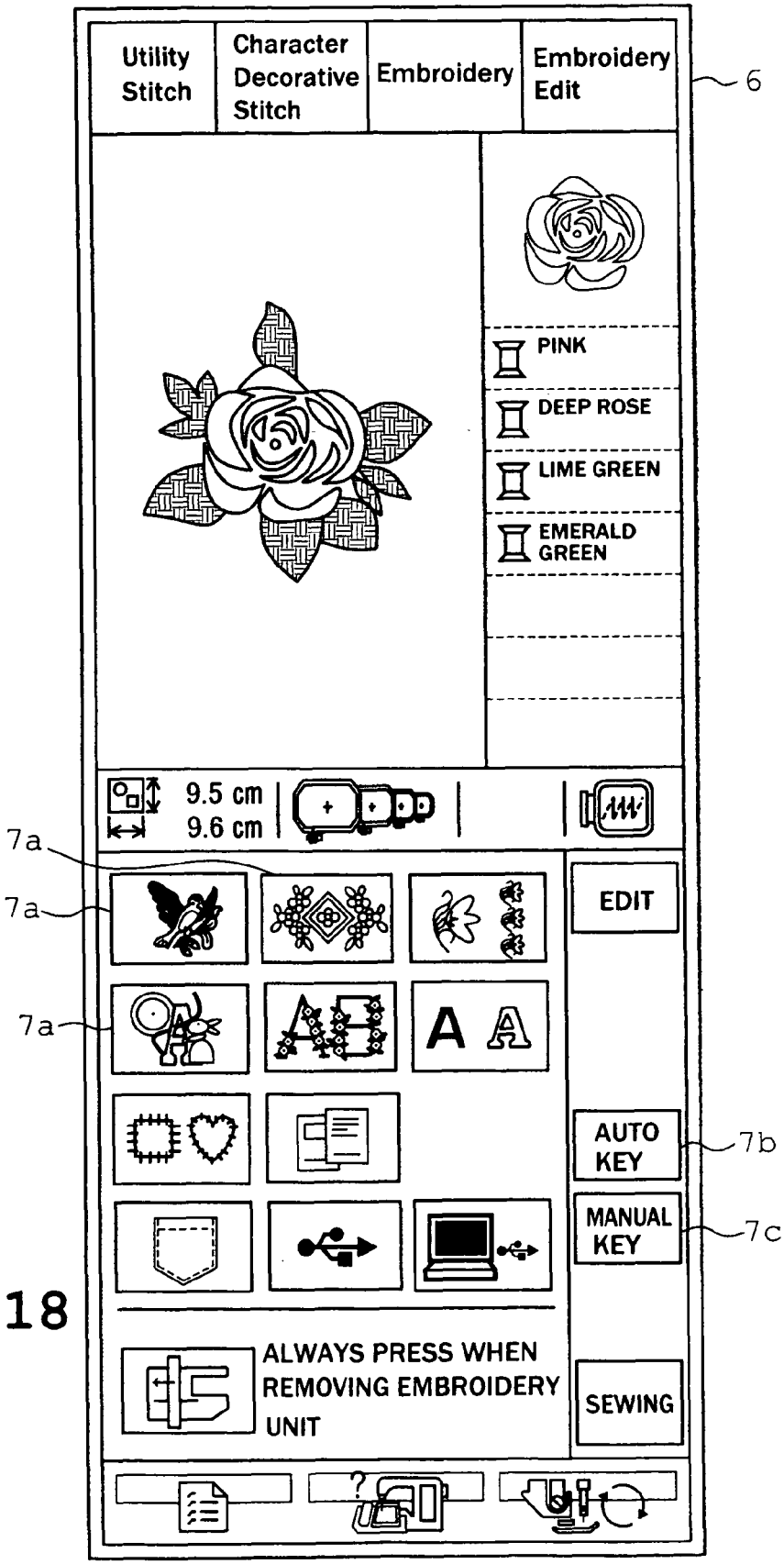
FIG. 18 is one exemplary image of a pattern selection screen.

Referring to FIG. 18, either one of the embroidery pattern group selection keys 7*a* is operated to select an embroidery pattern group, whereafter a pattern key is operated to select a desired embroidery pattern from the selected embroidery pattern group. At this instance, an auto key 7*b* and a manual key 7*c* are displayed on the LCD 6 for starting a temporary stitch data generating control in either automatic or manual of operation. The operation of the auto key 7*b* executes automatic sizing of the outline or geometric figure, whichever form of temporary stitching is applied, to a size that frames the embroidery pattern; whereas the operation of the manual key 7*c* executes manual sizing to a size that frames the embroidery pattern.

When temporary stitch data generating control is started, first, the CPU 26 reads the embroidery data of the selected embroidery pattern from the flash memory 29 into the data memory of the RAM 28 (S11). Then, if the auto key 7*b* is selectively operated from the auto key 7*b* and the manual key 7*c* displayed on the LCD 6 (S12: Yes, S13), the CPU 26 executes a first and a second auto generate control (refer to FIG. 5) (S14).

Figure 19:
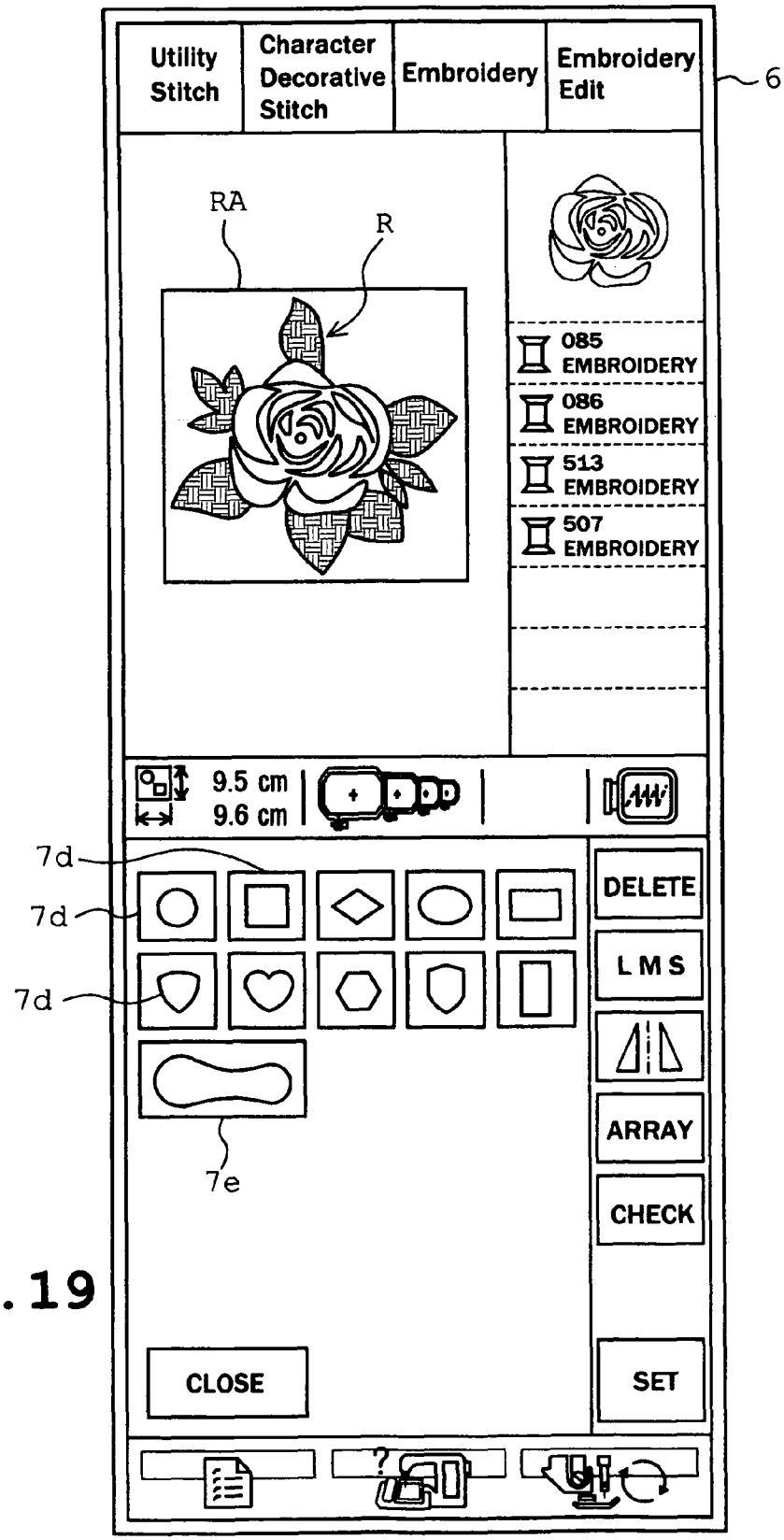
FIG. 19 is one exemplary display of a rectangular temporary outline during execution of automatic outline generation.

When the first and the second auto generate controls are started, first, the CPU 26 displays a plurality types of geometric figures and their corresponding keys 7*d* and a single outline figure and its corresponding key 7*e* (S21) on the LCD 6 as shown in FIG. 19. When the user selects the outline figure as a temporary stitch figure by operating the key 7*e* (S22), the CPU 26 executes an embroidery image generating control (refer to FIG. 6) for generating an embroidery image (S23).

Figure 13:
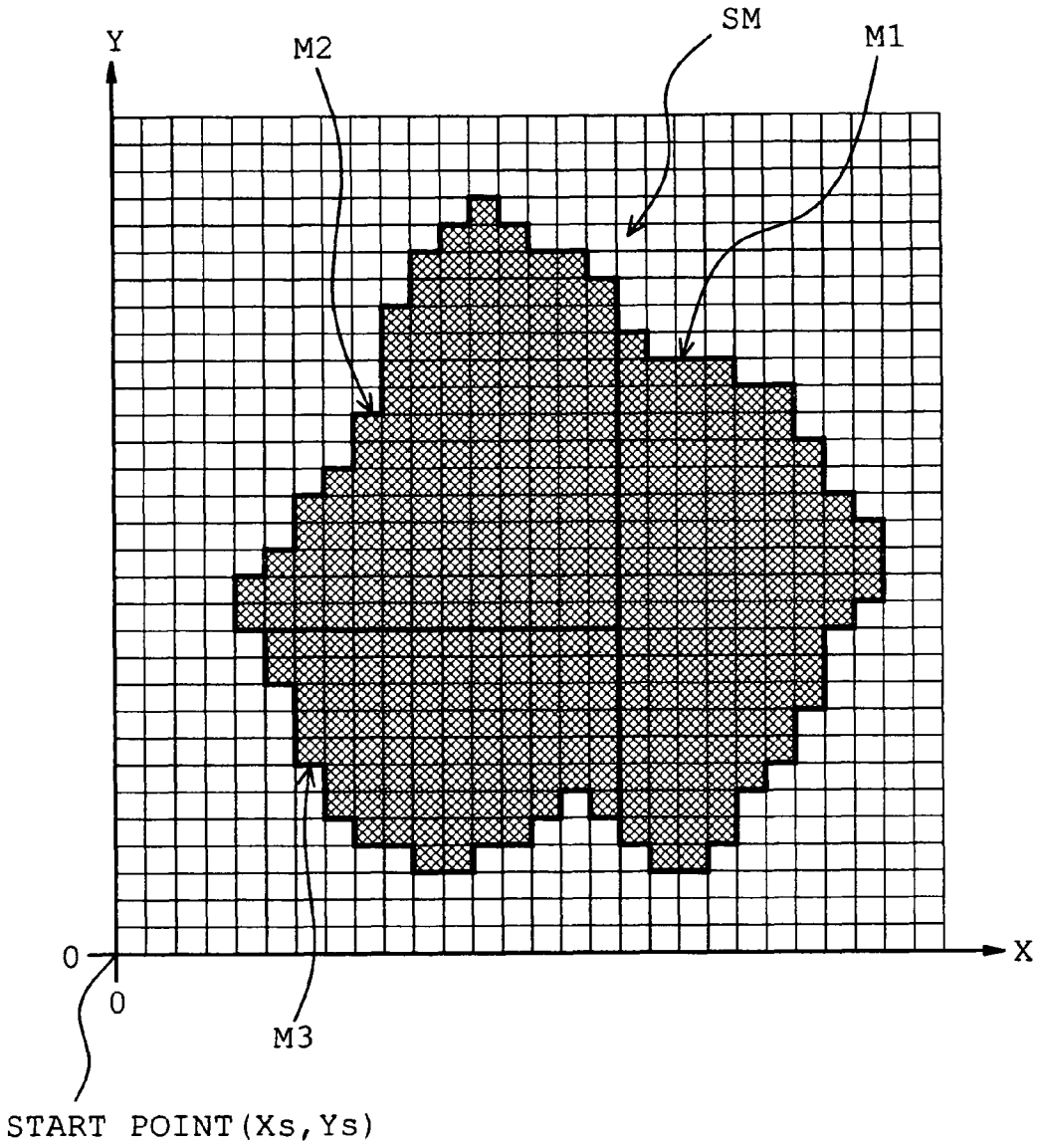
FIG. 13 is a descriptive illustration of an embroidery image obtained from the embroidery data.

When the embroidery image generating control is started, first, the CPU 26 initializes the starting coordinate (Xs, Ys) of the sample pattern SM (FIG. 13) of the embroidery image to "Xs←0, Ys←0" (41). Next, the CPU 26 initializes a pointer PT for addressing each data in the embroidery data to "zero" (S42).

Next, the CPU 26 sequentially addresses the data pointed by the pointer PT from the leading data of the embroidery data. If data exists in the pointed address (S43: Yes), and the pointed data is a control command such as "thread cut code" (S44: No), the pointer PT is incremented by one (S48), and S43 onwards are repeated. In case the data pointed by the pointer PT is needle drop data (S44: Yes), the needle drop data (ΔX, ΔY) is added to the start point (Xs, Ys) to calculate the end-point (Xe, Ye) indicative of the current needle drop point (S45).

Next, the CPU 26 executes a straight line drawing process to connect the start point (Xs, Ys) and the end point (Xe, Ye) (S46) by a straight line. In the straight line drawing process, the CPU 26 draws a straight line by black pixels of uniform darkness by Bresenham straight line drawing algorithm, for example. Next, the CPU 26 updates the current end point (Xe, Ye) as the start point (Xs, Ys) (S47), the pointer PT is incremented by one (S48), and S43 onwards are executed repeatedly. Of note is that, in case the start point (Xs, Ys) is the origin at the lower left of the embroidery image coordinate system shown in FIG. 13, the CPU 26 does not draw a straight line extending from the start point (Xs, Ys) to the corresponding end point (Xe, Ye).

When straight lines have been drawn for all the needle drop data for each of the pattern sections, since no more data remains to be addressed by the pointer PT (S43: No), the CPU 26 terminates the embroidery image generating control and the control flow returns to S24 of the first and the second auto generate control. In the straight line drawing process, a black pixel of uniform darkness is formed in each coordinate corresponding to each needle drop position of the first pattern section M1, the second pattern section M2, and the third pattern section M3 of the sample pattern SM shown in FIGS. 3 and 13 to generate an embroidery image shown in FIG. 14.

Figure 7:
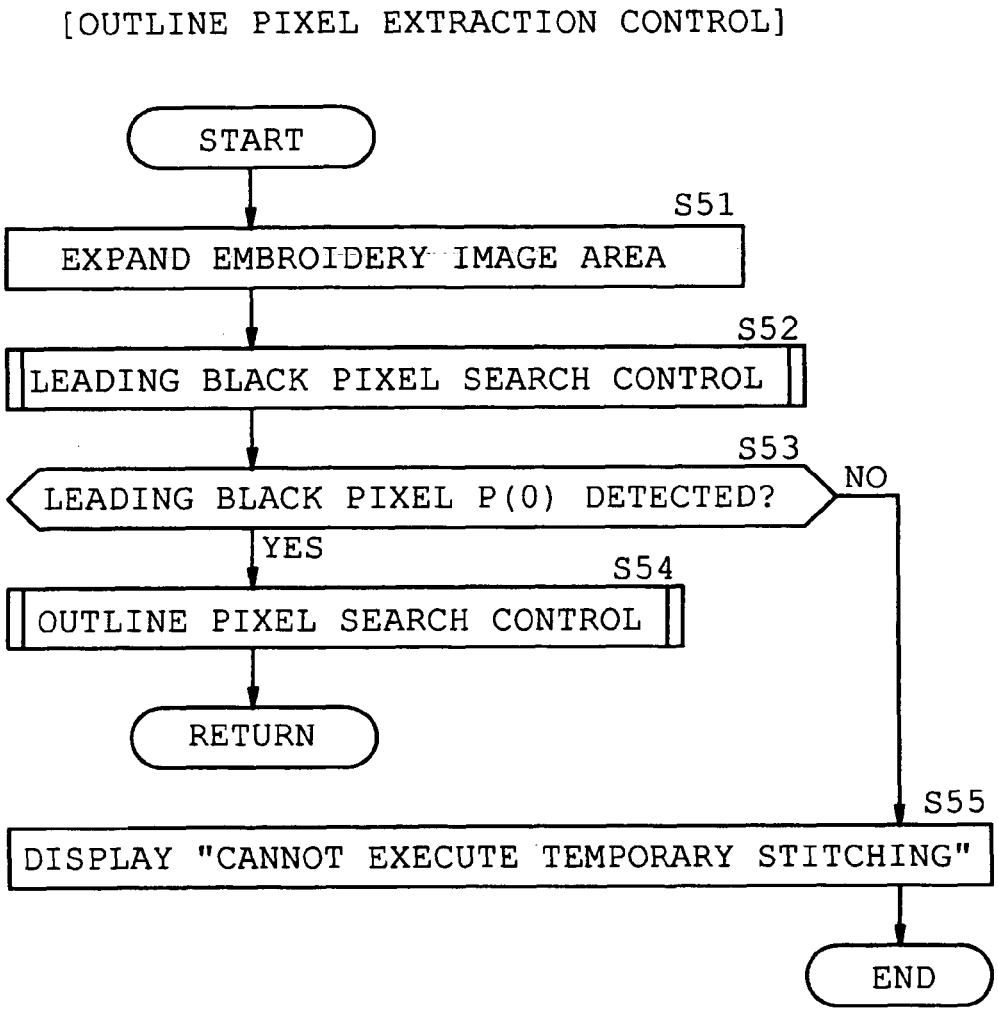
FIG. 7 is a flowchart of an outline pixel extraction control.
Figure 8:
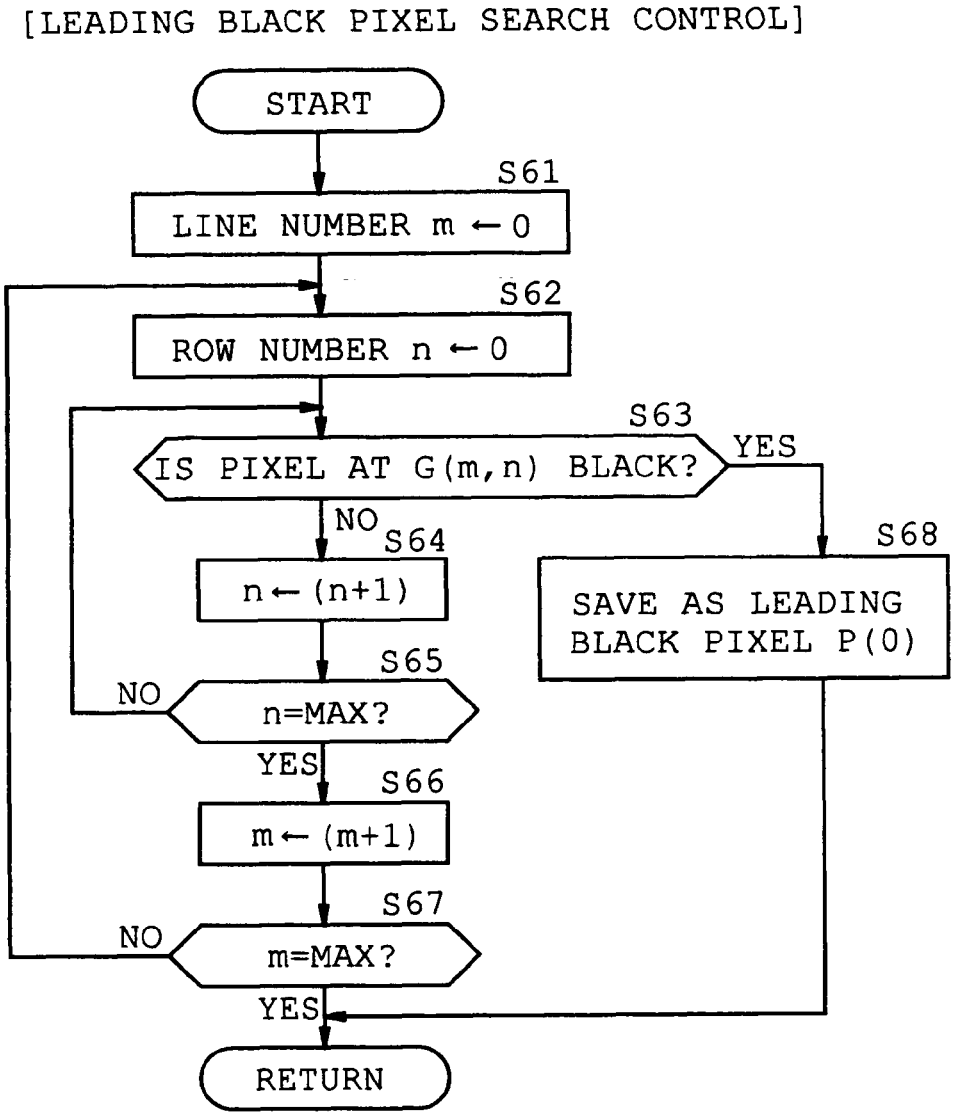
FIG. 8 is a flowchart of a leading black pixel search control.
Figure 9:
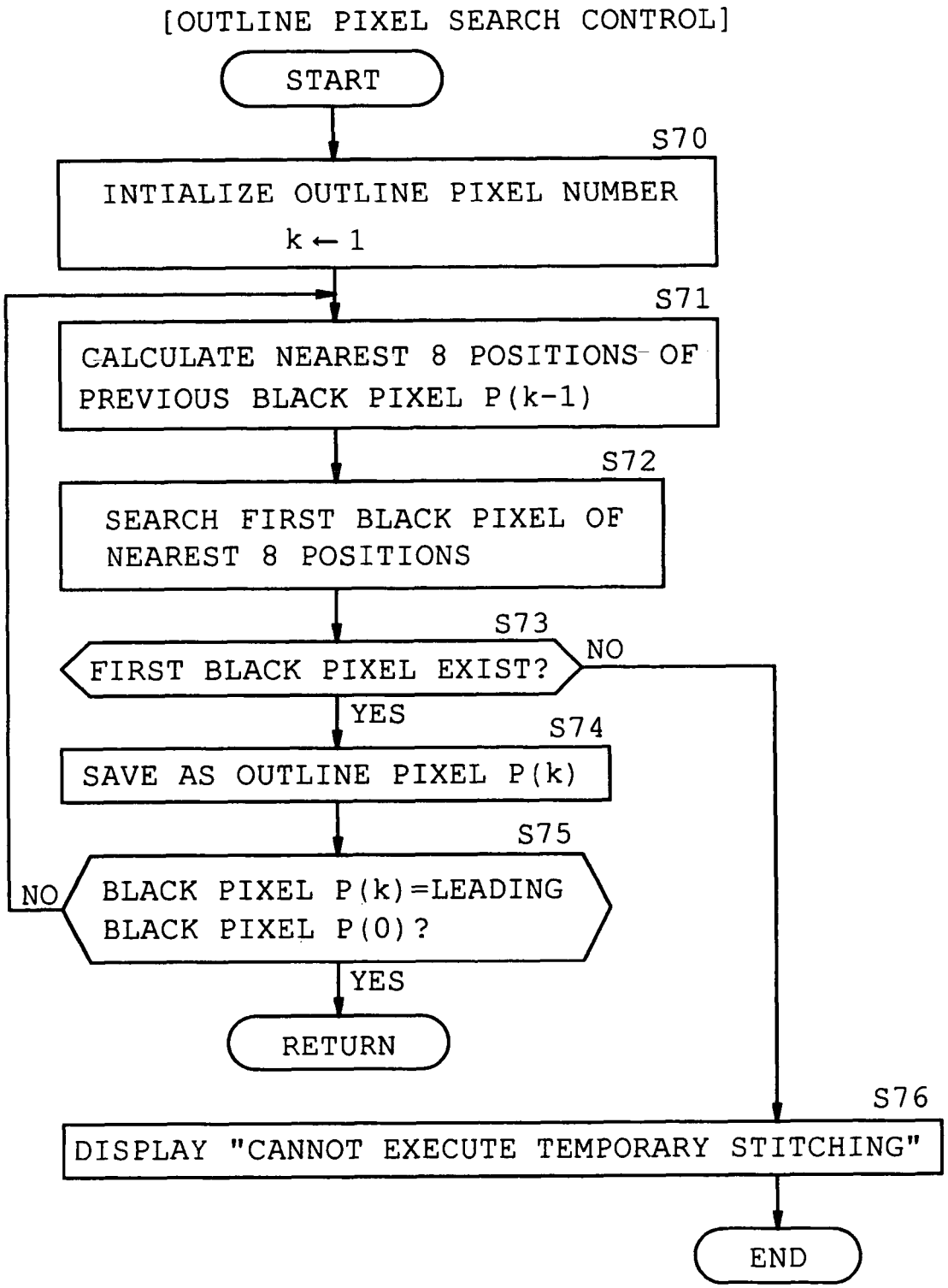
FIG. 9 is a flowchart of an outline pixel search control.
Figure 14:
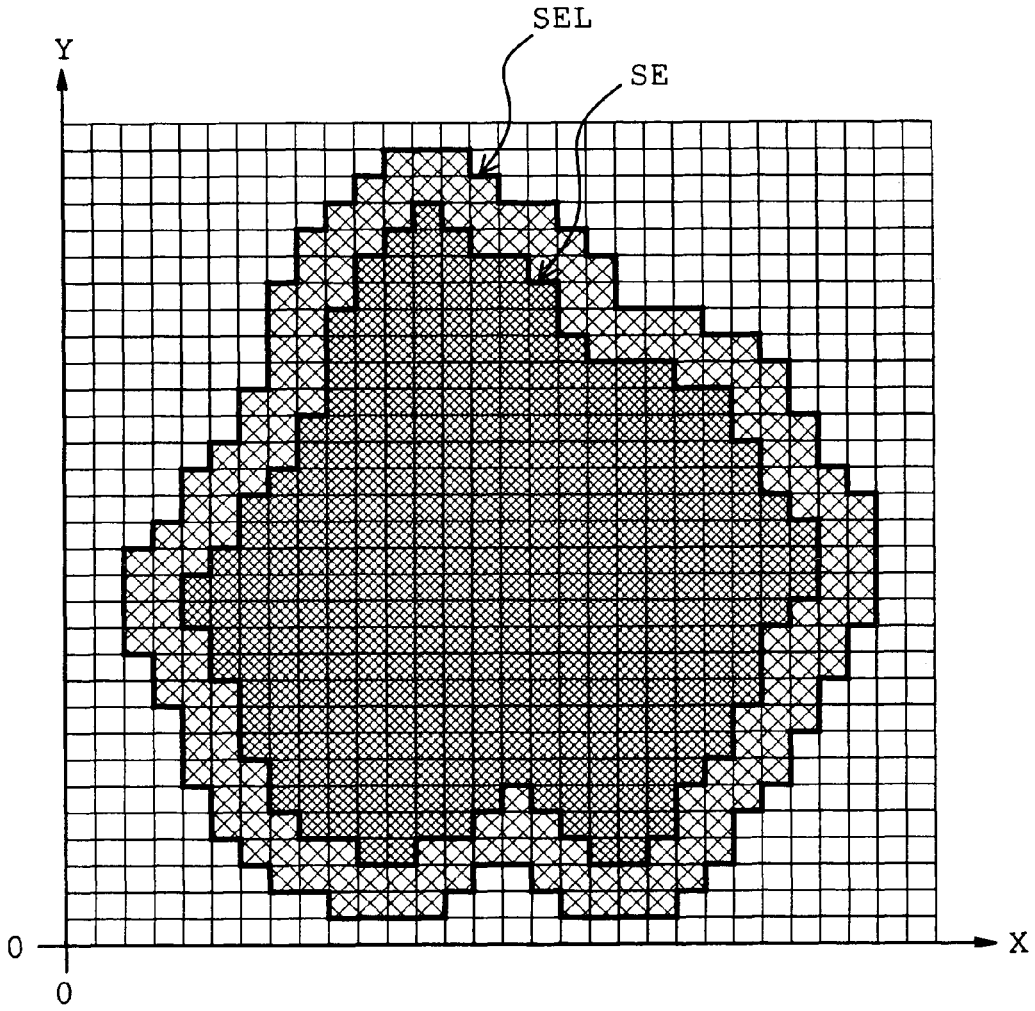
FIG. 14 is a descriptive illustration of an expanding process of the embroidery image.

Then the CPU 26 executes an outline pixel extraction control shown in FIG. 7 for extracting outline pixels in the first and second auto generating control (S24). When the outline pixel extraction control is started, first, the CPU 26 expands the embroidery image area SE obtained in the embroidery image generating process shown in FIG. 6 by a predetermined spacing (S51). For instance, the CPU 26 outwardly expands the embroidery image area SE of the sample pattern SM to region SEL as shown in FIG. 14. Next, as an initial step in obtaining the outline pixel, the CPU 26 executes a leading black pixel search control shown in FIG. 8 for searching the leading black pixel (S52).

When the leading black pixel search control is started, first, the CPU 26 initializes the line number m of the embroidery image to "zero" (S61), and likewise, the row number n to "zero" (S62). The following descriptions are based on the assumption that the uppermost block of the coordinate system for the embroidery image shown in FIG. 15 indicates line number m=0, and the leftmost row indicates row number n=0. Next, in case a given search position G (m, n) is not a "black" pixel (S63: No), the CPU 26 increments the row number n by one (S64), and if the row number n has not reached the maximum value MAX (S65: No), S63 to S65 are repeated. When the row number n reaches the maximum value MAX (S65: Yes), the CPU 26 increments the line number m by one (S66) and if the line number m has not reached the maximum value MAX (S67: No), S62 onwards are repeated.

Next, in case the pixel located in the search position G (m, n) is "black" (S63: Yes), the CPU 26 stores the black pixel corresponding to the current search position G (m, n) as the leading black pixel P(0) (S68). The control is then terminated and the control flow returns to S53 of the outline pixel search control. The CPU 26 stores the black pixel at coordinate (1, 11) of the embroidery image illustrated in FIG. 15 as the leading black pixel P(0). Then, in case the CPU 26 detects the leading black pixel in the outline pixel extraction control (S53: Yes), the outline pixel search control shown in FIG. 9 for searching the outline pixel is executed (S54). In case the CPU 26 fails to detect the leading black pixel (S53: No), a message reading "cannot execute temporary stitching" is displayed on the LCD 6 (S55).

As a first step after starting the outline pixel search control, the CPU 26 initializes the outline pixel number k to "1" (S70). Then, the CPU 26 calculates the nearest 8 positions (S71) for the previous black pixel P(k−1) and conducts a counterclockwise search of the pixels of these nearest 8 positions to find the first black pixel (S72). The CPU 26 starts the search at the first encountered counterclockwise pixel from the black pixel P(k−2) which precedes the black pixel P(k−1). Taking the embroidery image shown in FIG. 15 for example, the CPU 26 searches the initial occurrence of a black pixel among the positions (2, 10), (2, 11), (2, 12), (1, 12), (0, 12), (0, 11), (0, 10), and (1, 10) in the listed sequence constituting the nearest 8 positions of the leading black pixel P(0), which was detected in S68. Then, if the first black pixel has been detected (S73: Yes) as the result of the search, the CPU 26 stores the detected black pixel as an outline pixel P(k) (S74). In this case, the CPU 26 stores (2, 10) as the next black pixel P(1). No search start point P(k−1) exists when k=1; however, since it has been found in the leading black pixel search control shown in FIG. 8 that (0, 10), (0, 11), (0, 12) and (1, 10) are not black pixels, (2, 10) is stored as the next black pixel P(1).

Figure 15:
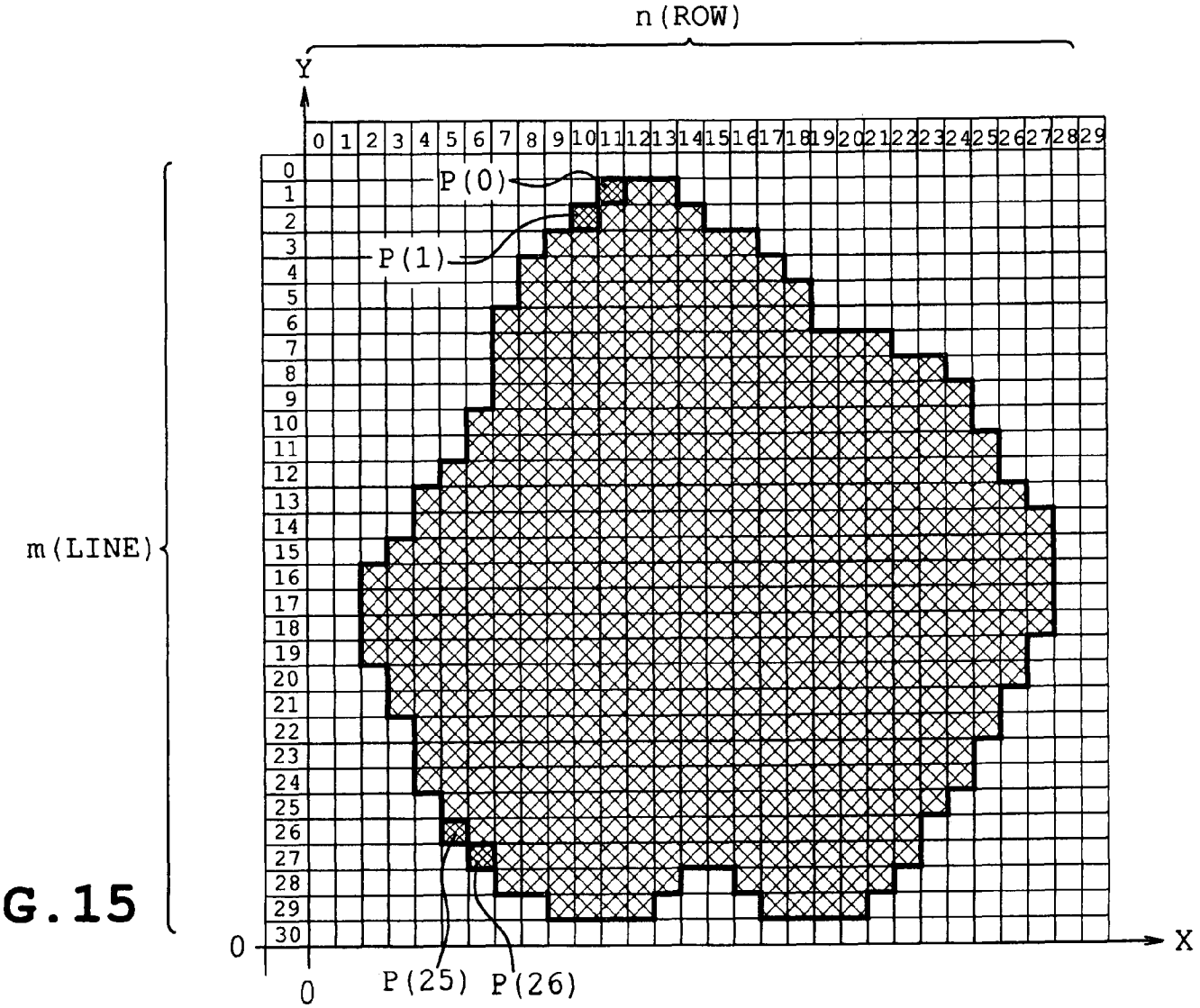
FIG. 15 is descriptive illustration of the leading black pixel search control.

Further description will be given by way of example with reference to FIG. 15 in which a search is made for the black pixel P(26) subsequently following the black pixel P(25). In this case, since the previous black pixel is (25, 5), the CPU 26 conducts the search starting from (25, 4) which is the next pixel following (25, 5), and proceeds with the counterclockwise sequential search of the nearest 8 positions. As a result of the search, the CPU 26 stores the first found black pixel (27, 6) as the next black pixel P(26).

Figure 16:
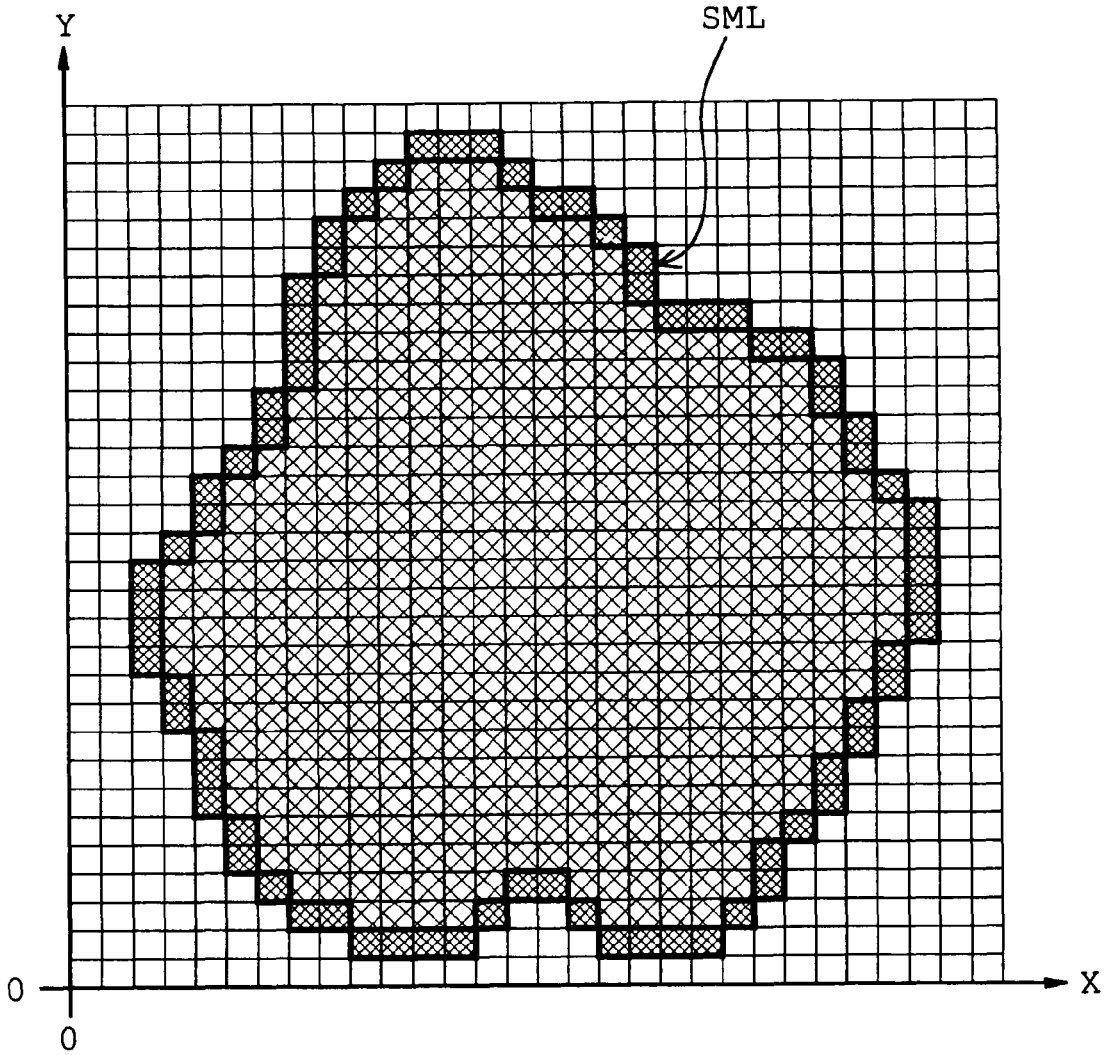
FIG. 16 is a descriptive illustration of an outline pixel.

While the black pixel P(k) being detected at S73 is not the leading black pixel P(0) (S75: No), the CPU 26 repeats S71 onwards. The search of the outline pixels conducted by the CPU 26 for the embroidery image illustrated in FIG. 15 results in FIG. 16, which shows the outer periphery SML of the expanded sample pattern SM being bordered in darker black. When encountering a black pixel P (k) that is equal to the leading black pixel P(0) (S75: Yes), which is an indication that all the outer peripheral pixels of the embroidery pattern have been searched, the CPU 26 terminates the outline pixel search control as well as the outline pixel extraction control and returns to S25 of the first and the second auto generate control. The CPU 26 creates an expanded temporary outline by connecting the outline pixels thus extracted as vertexes. In case the CPU 26 fails to find a black pixel in any of the nearest 8 positions (S73: No), a message is displayed on the LCD 6 that reads "cannot execute temporary stitching" (S76).

Then, in the first and second auto generate control, the CPU 26 executes temporary outline generating control (refer to FIG. 10) (S25) to generate a temporary outline that smoothes the expanded temporary outline. As an initial step after starting the temporary outline generating control, the segment start point L(S) is initialized (S←0) (S81), and the segment start point L(S) is specified (S82). Then, the CPU 26 specifies segment end point L(E) as shown in FIG. 10 (S83), and specifies the segment end point L(E) (S84).

Figure 10A:
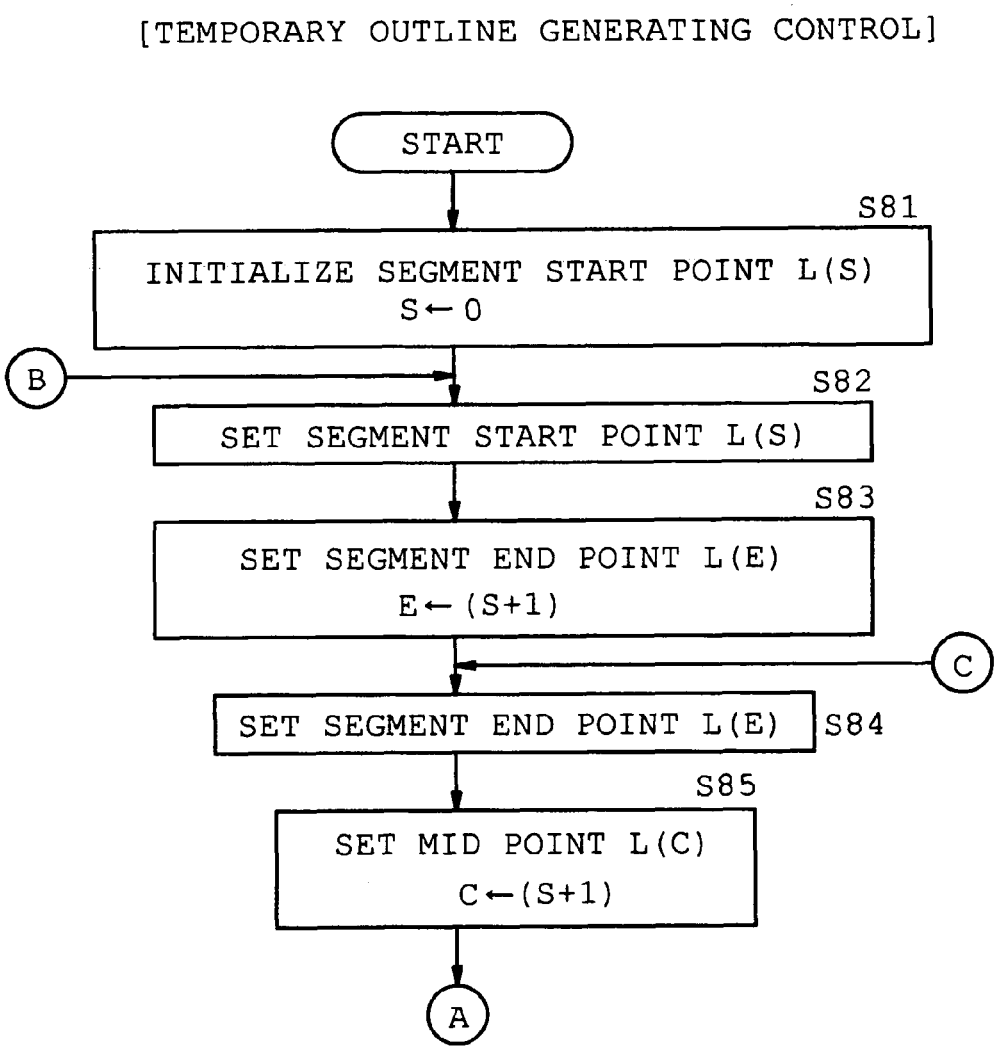
FIG. 10 is a flowchart of a temporary outline generating control.
Figure 10B:
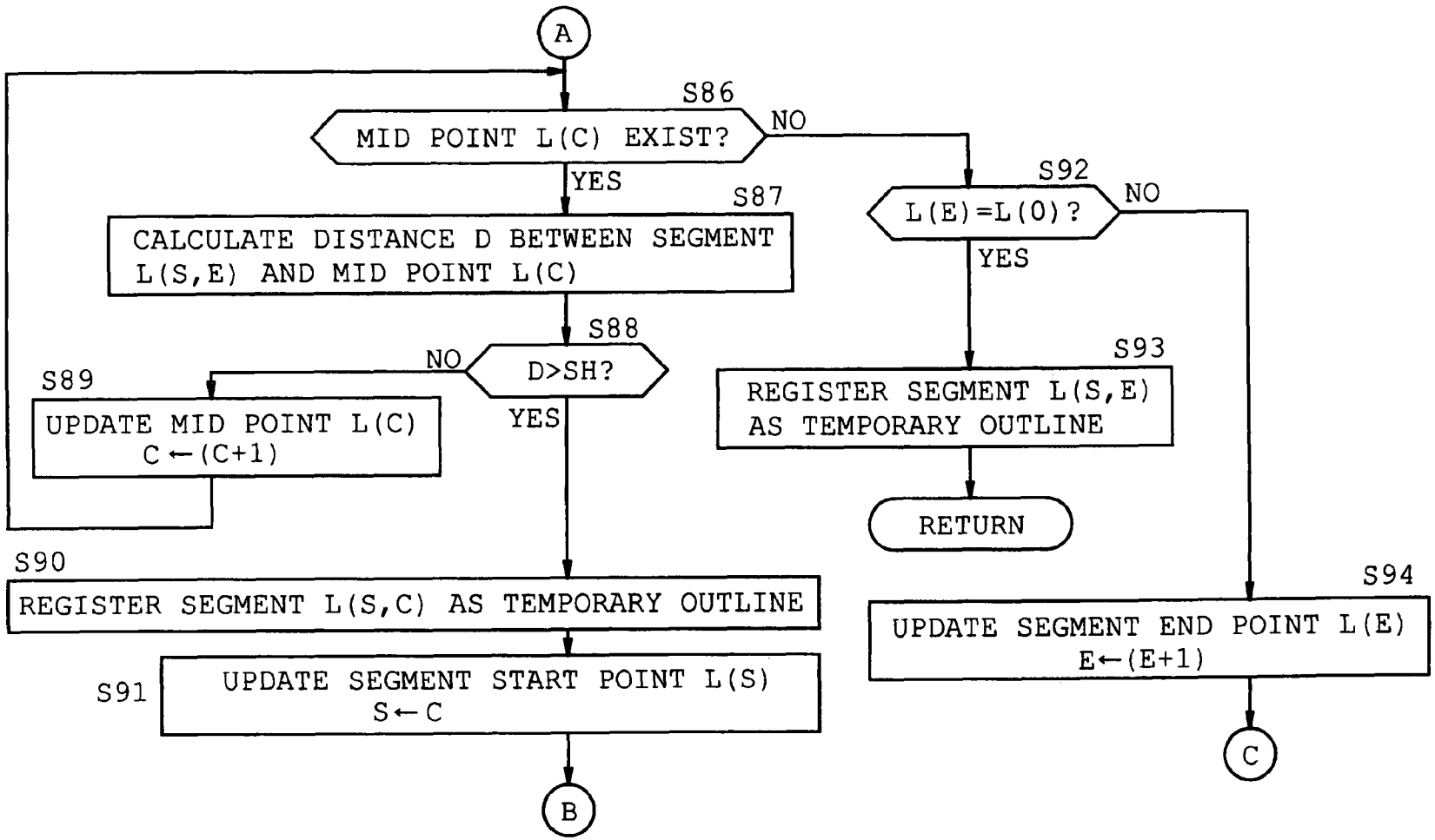
Figure 11:
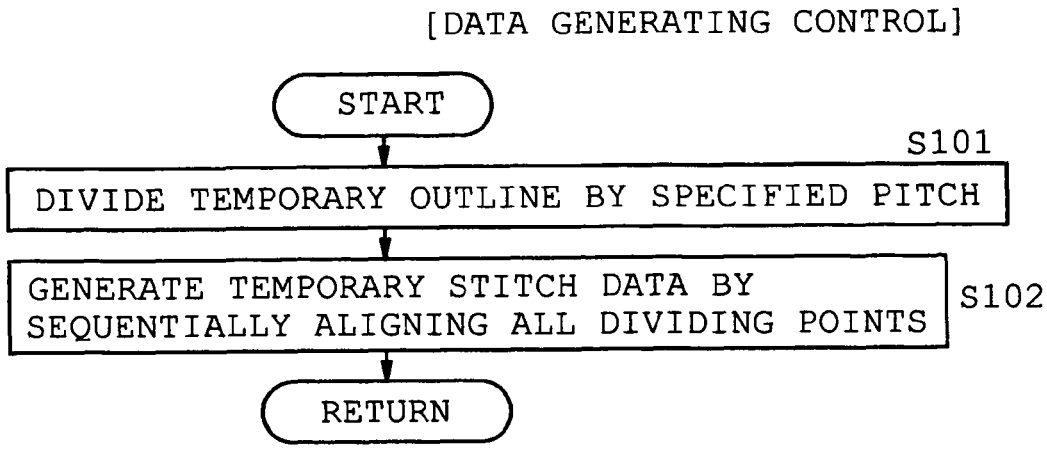
FIG. 11 is a flowchart of a data generating control.
Figure 12:
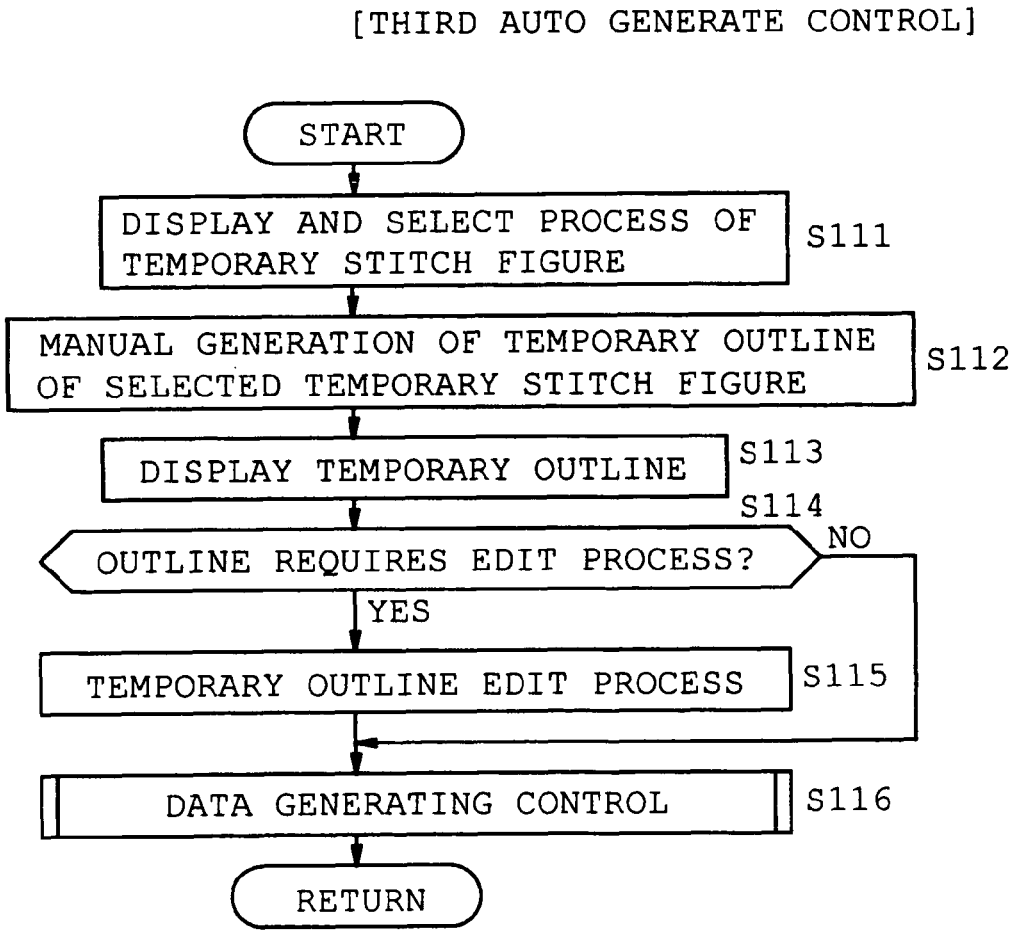
FIG. 12 is a flowchart of a third auto generate control.

Next, as shown in FIG. 10, the CPU 26 specifies a mid point L(C) constituting a vertex on the expanded temporary outline and interposing the segment start point L(S) and segment end point L(E) (S85). Then, if no mid point L(C) is found (S86: No), and the segment end point L(E) is not equal to the leading segment start point L(0) (S92: No), the segment end point L(E) is updated (S94) as shown in FIG. 10 and S84 onwards are repeated. If a mid point L(C) is found (S86: Yes), a vertical distance D between the mid point L(C) and segment L(S, E) comprising the connected segment start point L(S) and segment endpoint L(E), is calculated (S87).

Then, if the vertical distance D is equal to or less than a predetermined value SH (S88: No), the CPU 26 updates the mid point L(C) as shown in FIG. 10 (S89) and repeats S86 onwards. When the vertical distance D is greater than the predetermined value SH (S88: Yes), the CPU 26 registers the segment L(S, C) connecting the segment start point L(S) and mid point L(C) as the temporary outline (S90), updates segment start point L(S) as shown in FIG. 10 (S91), and repeats S82 onwards.

Figure 17:
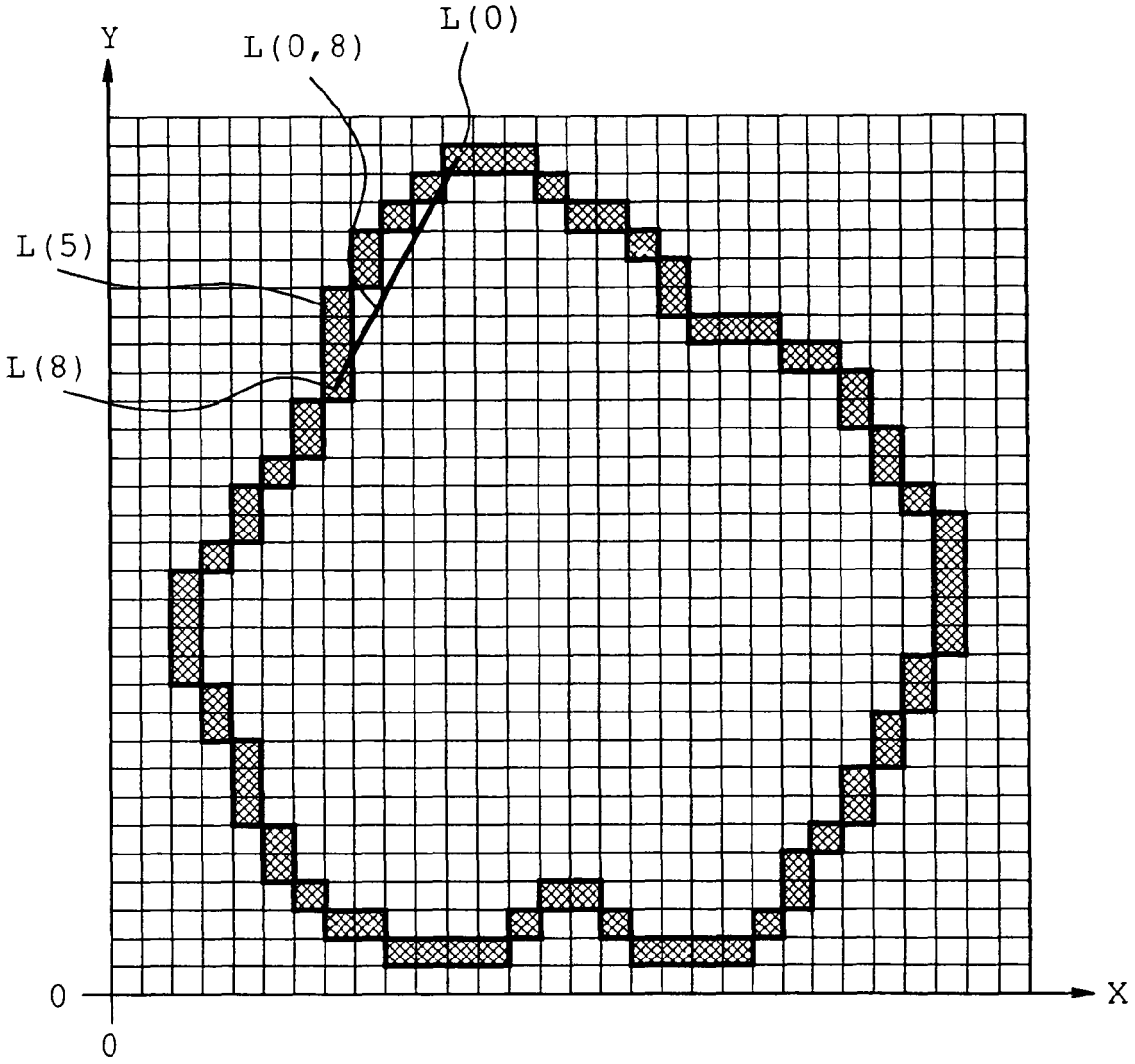
FIG. 17 is a descriptive illustration of a temporary outline.

If no mid point L(C) is found (S86: No), and segment end point L(E) is equal to the leading segment start point L(0) (S92: Yes), the CPU 26 registers segment L(S, E) as the temporary outline (S93) to terminate the temporary outline generating control. The control subsequently returns to S26 of the first and the second auto generate controls. Taking the plurality of outline pixels (refer to FIG. 16) obtained by the outline pixel extraction control for example, first, the CPU 26 specifies L(0) as the segment start point, L(8) as the segment end point, and calculates vertical distance D for mid points L(1) to L(7) respectively as shown in FIG. 17. If the vertical distance D between mid point L(5) and segment L(0, 8), connecting segment start point L(0) and segment end point L(8) is greater than the predetermined distance SH, the CPU 26 registers segment L (0, 5), that connects segment start point L(0) and mid point L(5), as the temporary outline.

Figure 20:
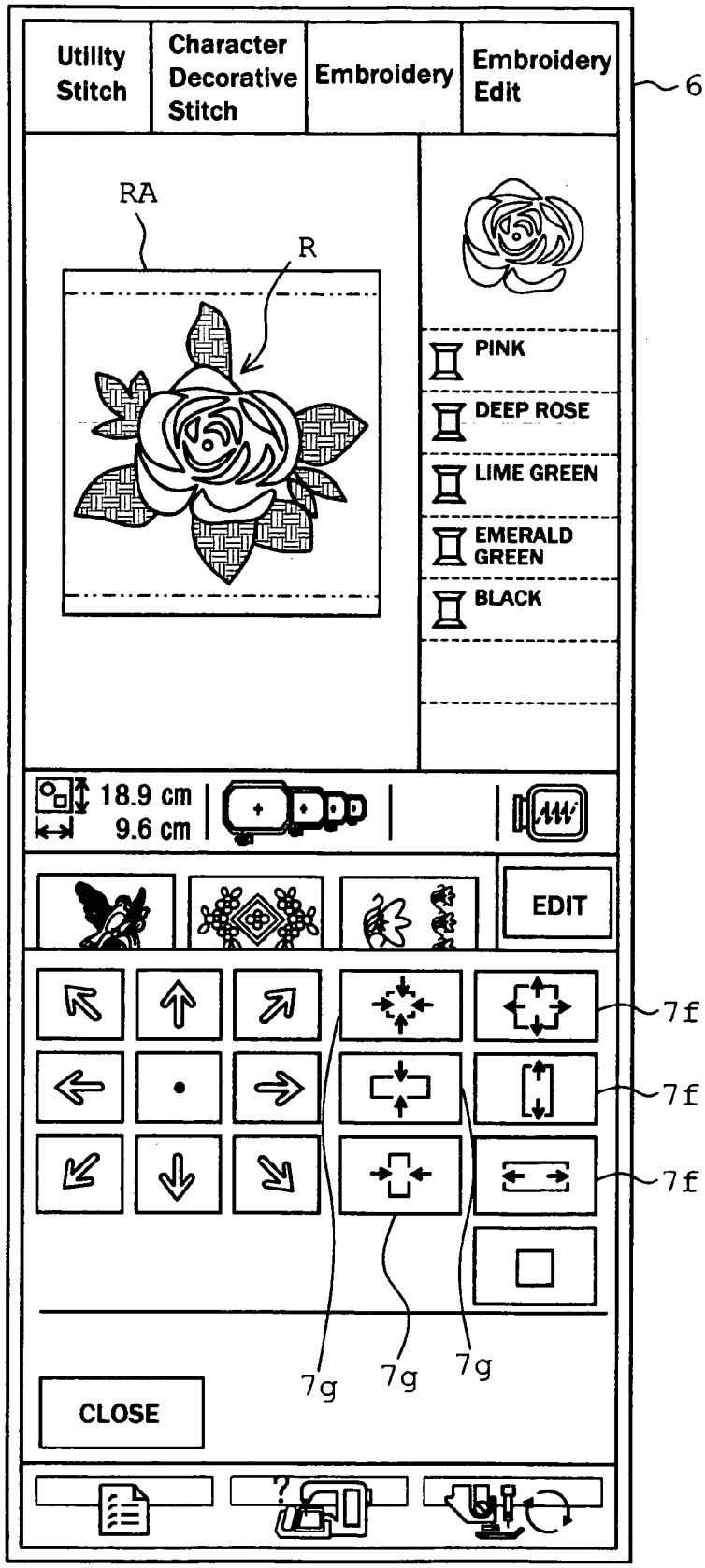
FIG. 20 is one exemplary image of an edit screen displayed during execution of automatic outline generation.

In the first and the second auto generate controls, the CPU 26 outputs the temporary outline generated in the subsequent S25 on the LCD 6 (S26). At this instance, the CPU 26 also displays various editing keys for editing the generated temporary outlines on the LCD 6. Referring to FIG. 20 for instance, an expand key 7*f* and a shrink key 7*g* for increasing and reducing the size of the generated temporary outline are displayed.

If the user chooses to edit the outline by operation of the various keys (S27: Yes), the CPU 26 performs various edit processes corresponding to the operated keys on the temporary outline and the edited temporary outline is displayed on the LCD 6 (S28). Referring to FIG. 20, when the expand key 7*f* is operated, the CPU 26 expands the temporary outline accordingly, whereas upon operation of the shrink key 7*g*, the temporary outline is reduced in size accordingly. Then, based on the edited temporary outline obtained at step S28, the CPU 26 executes the data generating control (refer to FIG. 11) for generating the temporary stitch data (S29).

As the first step after starting the data generating control, the CPU 26 acquires dividing points that divide all the temporary outlines obtained by temporary outline generating control shown in FIG. 10 by a specified pitch (approximately 10 mm, for example) (S101). Then, the CPU 26 sequentially aligns all the dividing points to generate the temporary stitch data (S102), whereafter the data generating control and the first and second auto generate controls are terminated and the control is returned to S15 of the temporary stitch data generating control.

If the user operates the key 7*d* to select a geometric figure as the temporary stitch figure (S22) among the plurality types of geometric FIG. 7*d* and a single outline FIG. 7*e* displayed on the LCD 6 (S21), the CPU 26 executes a geometric figure outline generating control for generating the geometric figure outline (S30). In the geometric figure outline generating control, the CPU 26 executes a process that automatically generates geometric figures from the mask information of the embroidery data. Then, the CPU 26 displays the generated temporary outline (S26).

For example, FIG. 19 shows the embroidery pattern "rose" R and the selected rectangular temporary stitch figure RA on the LCD 6. The rectangular temporary stitch figure RA is expanded based on the mask information of the embroidery pattern "rose" R. More specifically, a rectangular frame is obtained based on the mask information of the temporary stitch figure and the rectangular temporary stitch figure RA is expanded about the diagonal crossover of the obtained rectangular frame so as not to overlap with the "rose" R.

Figure 21:
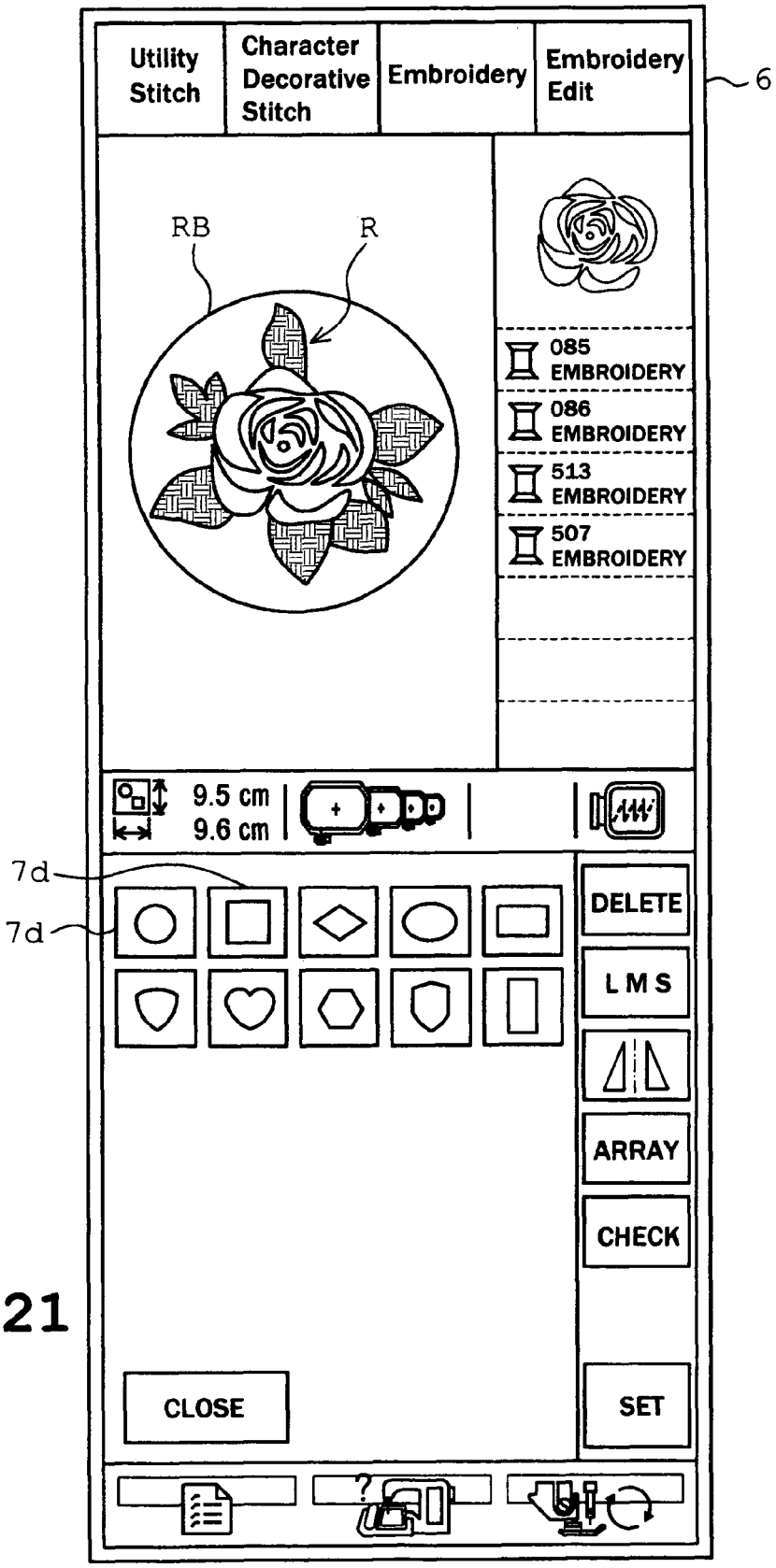
FIG. 21 is one exemplary display of a circular temporary outline during execution of automatic outline generation.

Then, in case the temporary outline editing process is executed for editing the temporary outline in S27 and S28, the CPU 26 displays the embroidery pattern rose R and the vertically expanded rectangular temporary stitch figure RA, for example, on the LCD 6 as shown in FIG. 20. On the other hand, when a geometric figure "o" is selected, the CPU 26 displays the embroidery pattern rose R and the circular temporary stitch figure RB on the LCD 6 as shown in FIG. 21.

The circular temporary stitch figure RB is also obtained pursuant to the manner described above. That is, a rectangular frame is obtained based on the mask information of the embroidery pattern "rose" R, based upon which a circle is further obtained that centers on the diagonal crossover of the rectangular frame, and the diagonal lines crossing over to define the center of the circle further define the diameter of the circle. The diameter of the circular temporary stitch figure RB is increased so as not to overlap with the "rose" R.

Figure 22:
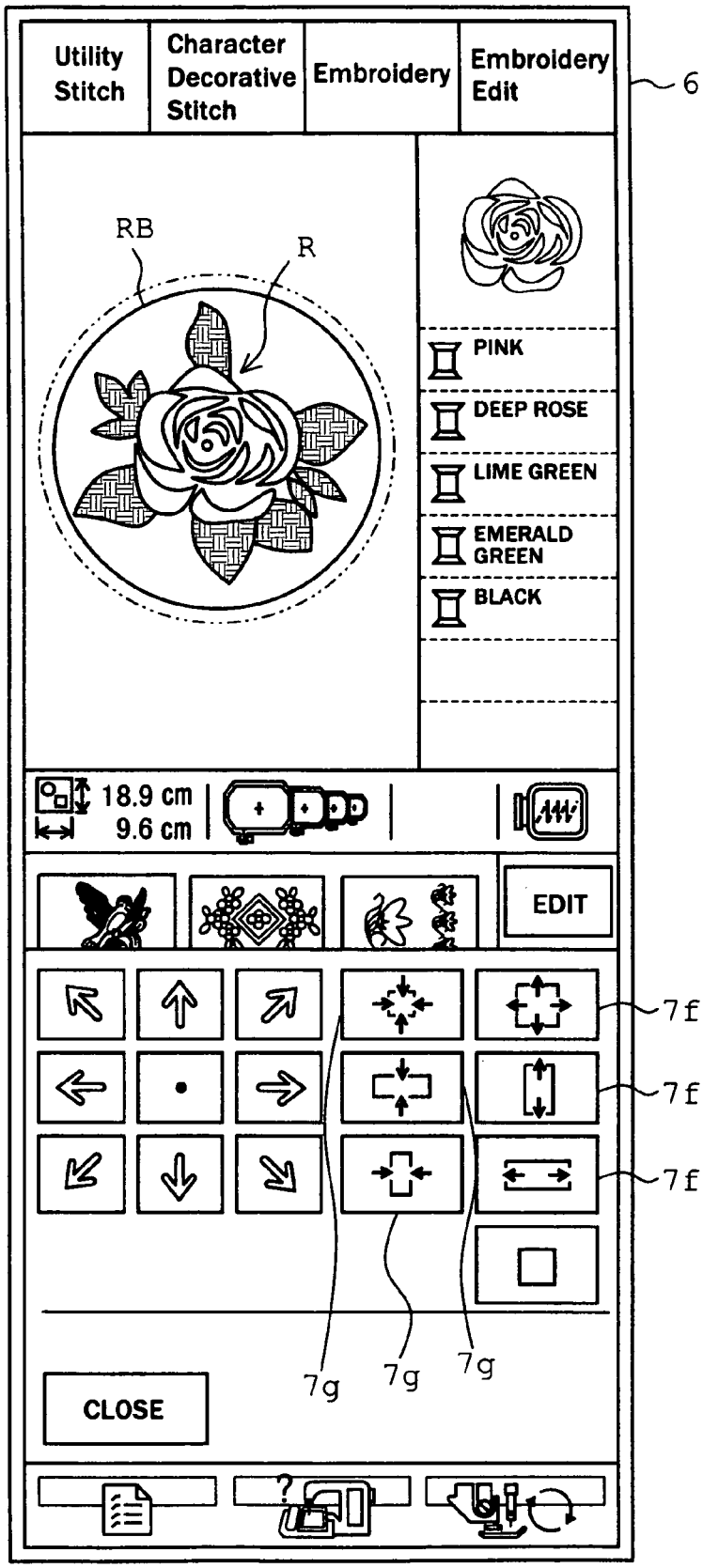
FIG. 22 is another exemplary image of the edit screen displayed during execution of automatic outline generation.
Figure 23:
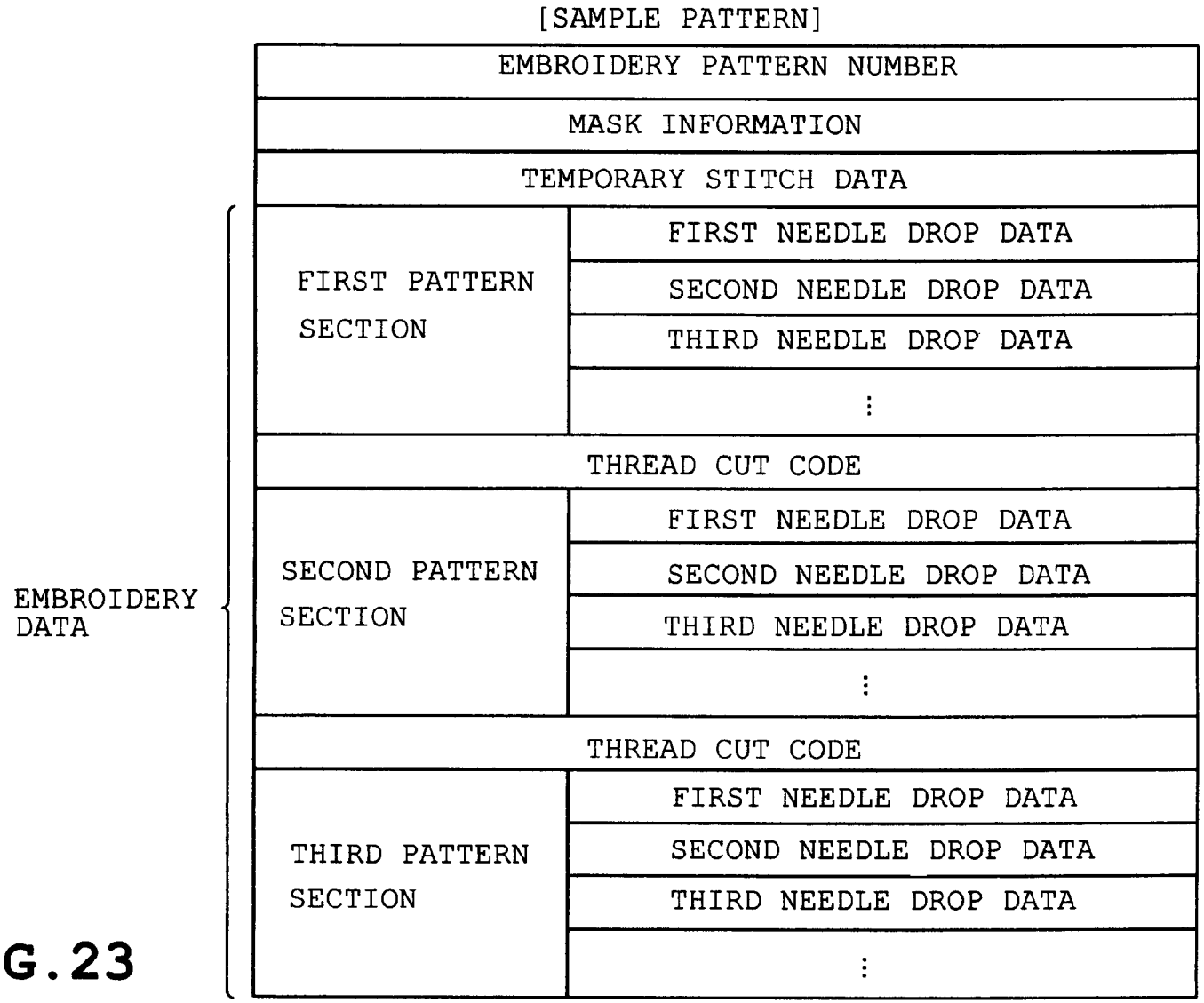
FIG. 23 corresponds to FIG. 3 and shows the temporary stitch data stored in a leading end of the embroidery data.

In case the temporary outline editing process is executed, the CPU 26 displays the embroidery pattern rose R and the circular temporary stitch figure RB reduced in size, for example on the LCD 6 as shown in FIG. 22.

Then, in the temporary outline data generating control, the CPU 26 stores the temporary stitch data generated in S14 or S16 in the data memory of the RAM 28 so that the temporary stitch data is stored before (immediately before) the embroidery data of the selected embroidery pattern (S15) and terminates the temporary stitch data generating control.

On the other hand, if the user selectively operates the manual key 7*c* from the two temporary stitch keys, namely the auto key 7*b* and the manual key 7*c* displayed on the LCD 6 (S12: Yes, S13), the CPU 26 executes the third auto generate control (refer to FIG. 12) (S16).

As the first step after starting the third auto generate control, the CPU 26 displays a plurality types of geometric figures on the LCD 6 for user selection according to user preference (S111). Then, the temporary outline for the selected temporary stitch figure is generated by manual operation (S112). Temporary outline is generated by using tools such general purpose graphic editing software.

For example, as shown in FIG. 19, after selecting a geometric figure "□" displayed on the LCD 6, when opposing 2 corners surrounding the embroidery pattern "rose R" is depressed on the touch panel 7, a rectangular temporary outline is generated. Similarly, if a geometric circle "o" is selected, a circular temporary outline is generated as shown in FIG. 21 by depressing two given locations of the touch panel 7 to determine the center and the radius of the circle. Though not shown, a temporary outline may be generated such that the embroidery pattern "rose R" is enclosed by a combination of plurality of straight lines and free curves.

Further, the above described touch panel 7 operations being made by finger tip or touch pen depression may be carried out by connecting a pointing device not shown such as a mouse to the sewing machine M.

Next, the CPU 26 displays the temporary outline thus created on the LCD 6 (S113). At this instance, the CPU 26 also displays various edit keys on the LCD 6 to allow editing of the generated temporary outline. For example, the expand key 7*f* and the shrink key 7*g* for increasing and reducing the size of the generated temporary outline are displayed. If the outline requires editing (S114: Yes), various editing processes are executed on the temporary outline by user operation of the corresponding edit keys, whereafter the edited temporary outline is displayed on the LCD 6 (S115). For instance, when the expand key 7*f* is operated, the CPU 26 executes a corresponding size increase process on the temporary outline; whereas when the shrink key 7*g* is operated, a corresponding size reduction process is executed on the temporary outline. Next, the CPU 26 executes the data generating control (refer to FIG. 11) based on the edited temporary outline obtained in S115 (S116).

As the first step after starting the data generating control, the CPU 26 obtains dividing points that divides all of the temporary outlines obtained in the temporary outline generating control by a predetermined pitch (10 mm, for example) as shown in FIG. 10 (S101). Then, the CPU 26 sequentially aligns all the dividing points to generate the temporary stitch data (S102) and terminates the data generating control and the third auto generate control, whereafter the control is returned to S15 of the temporary stitch data generating control.

Figure 24:
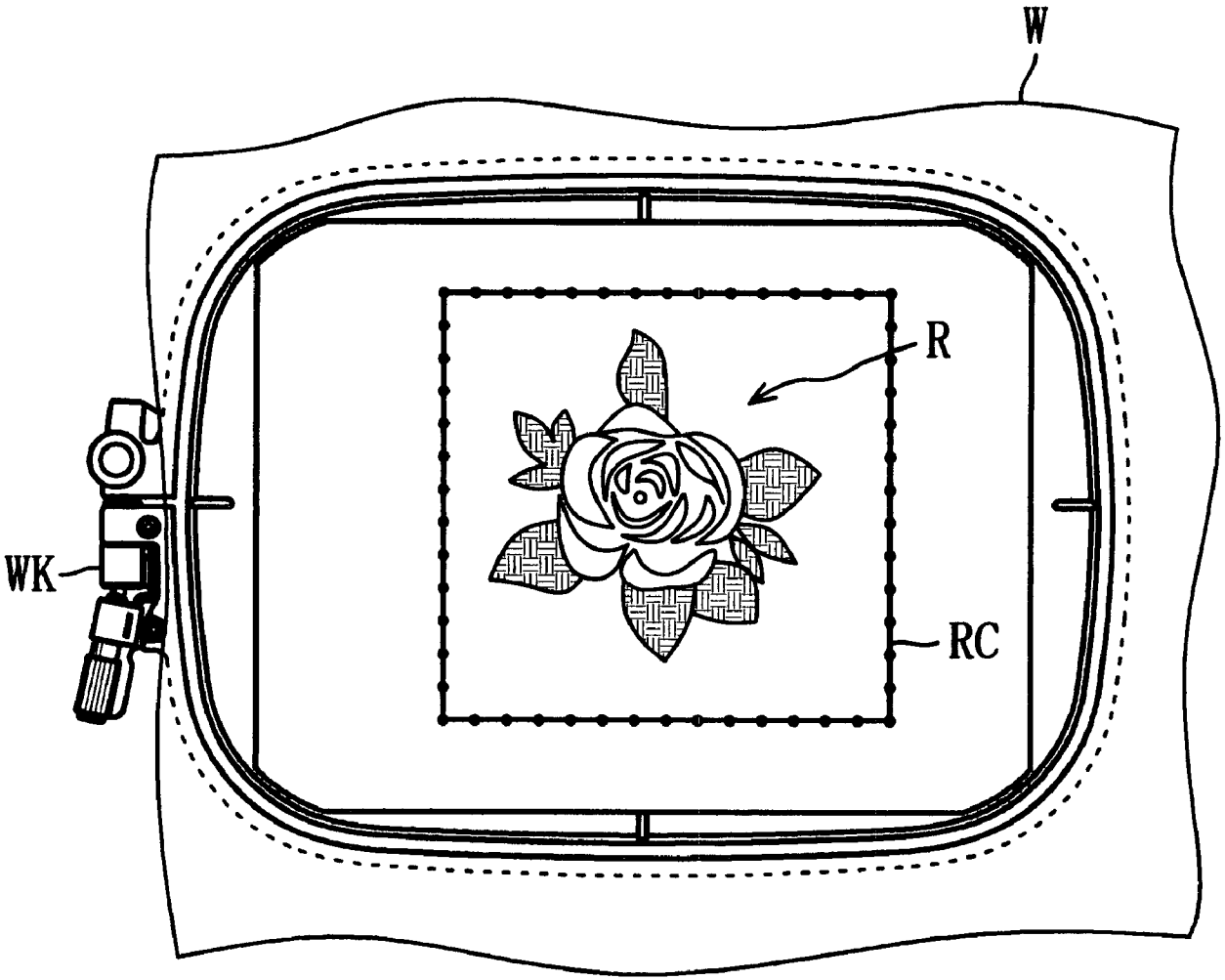
FIG. 24 illustrates temporary stitches and an embroidery pattern sewn on a workpiece cloth attached to an embroidery frame.

As described above, the CPU 26 stores the temporary stitch data generated in S14 and S16 at a location in the data memory of the RAM 28 that precedes the embroidery data. As shown in FIG. 24, the workpiece cloth W and an interlining (not shown) superimposed on the underside of the workpiece cloth W are set on the embroidery frame WK. The embroidery frame WK is attached to the embroidery frame drive mechanism 10 of the sewing machine M by the user to start the sewing operation. Thus, a basting stitch RC in the form of a rectangular geometric figure is formed based on the temporary stitch data prior to the start of sewing operation. Then, the sewing operation is executed based on the embroidery data of the rose R selected earlier as the embroidery pattern to be sewn.

Figure 25:
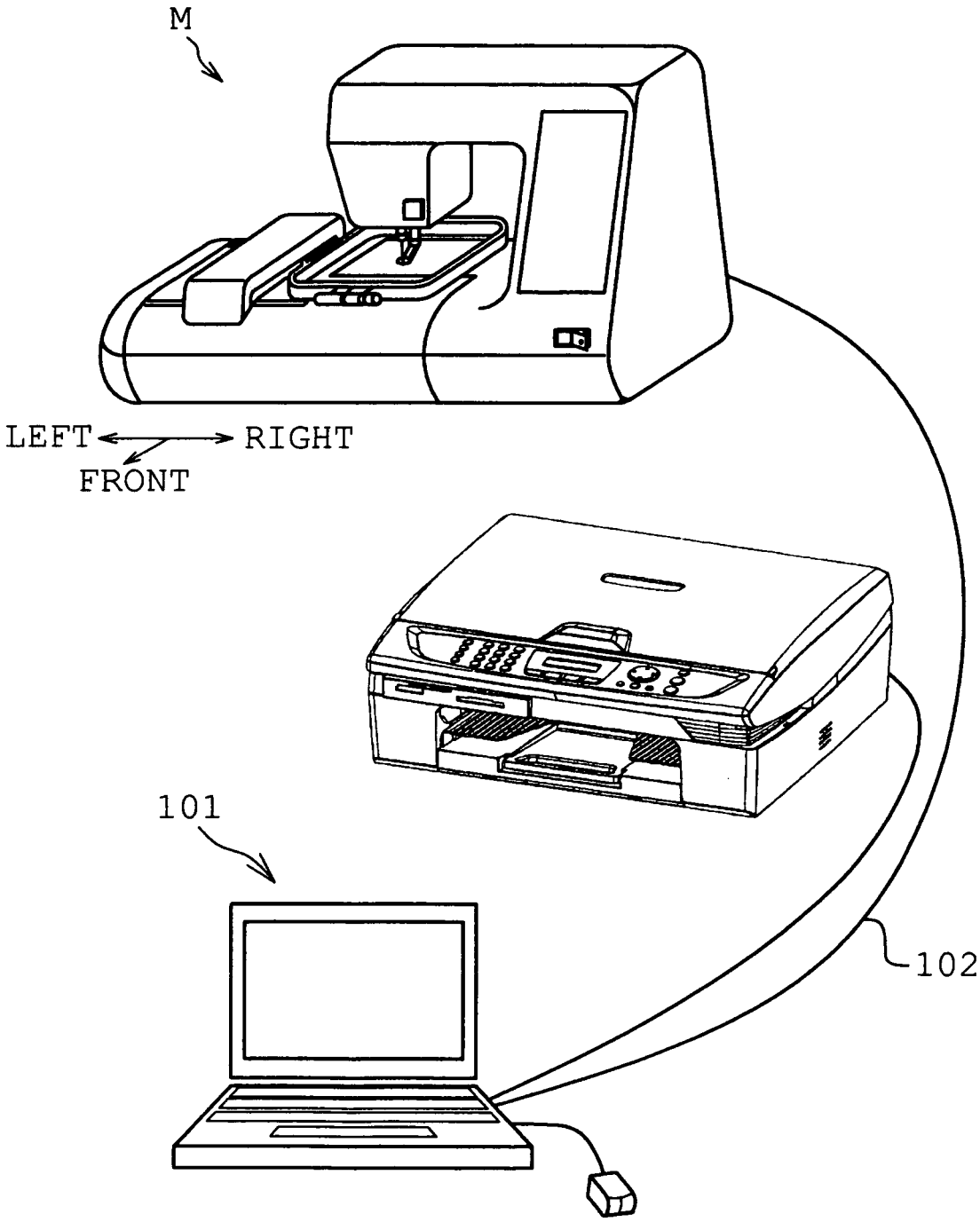
FIG. 25 shows a modified illustrative aspect of the present disclosure.

The processor that process embroidery data is not limited to the controller 25 housed in the sewing machine M, but it may be provided in the form of a personal computer 101 as shown in FIG. 25. For instance, the personal computer 101 may be connected to the sewing machine M via connection line 102, and the temporary stitch data generated by the personal computer 101 may be transmitted to the sewing machine M via the connection line 102. The personal computer 101 may further establish a wireless connection with the sewing machine M or exchange data via medium such as USB memory.

Further, the control program for the temporary stitch data generating control stored in the ROM 27 of the controller 25 serving as the embroidery data processor may be retrievably stored in other types of nonvolatile memory such as a flexible disk, a CD-ROM, and memory cards.

As described above, as a preparatory step prior to sewing the embroidery pattern with the embroiderable sewing machine M, temporary stitch data is generated based on the embroidery data of the embroidery pattern pre-selected by the user. Interlining is applied on the underside of the workpiece cloth W and set on the embroidery frame WK by the user. Then, the interlining is temporarily sewn on the underside of the workpiece cloth W based on the temporary stitch data prior to execution of embroidery sewing. Thus, the interlining can be sewn on the underside of the workpiece cloth W by using the temporary stitch data generated based on the embroidery data used for embroidering. Thus, adhesion of interlining on the underside of the workpiece cloth W with an electric iron or electric solder can be eliminated completely and the object of preventing gathering and providing reinforcing support to the workpiece cloth W can be achieved by easy and quick integration of the workpiece cloth W and the interlining. Further, the interlining can be readily removed by cutting off the temporary stitches after sewing of embroidery patterns have been completed.

Moreover, since the temporary stitch data is generated automatically from the embroidery data, the user is merely required to select the embroidery pattern to be sewn, which significantly accelerates data generation of the temporary stitch data for temporarily sewing the workpiece cloth W with the interlining. Furthermore, since the temporary stitch data is generated along the expanded outline which is outwardly spaced by a predetermined spacing relative to the original outline, desirable temporary stitches that do not overlap with the embroidery pattern can be formed. Yet furthermore, if a geometric figure is selected by the user, temporary stitch data is generated so that the embroidery pattern is framed in the selected geometric figure. Thus, the user is allowed to select the desirable geometric figure and set the size of the geometric figure to frame the embroidery pattern according to user preference to automatically generate the temporary stitch data of the geometric figure.

Partial modifications of the above described embodiment will be described hereinafter.

Figure 26:
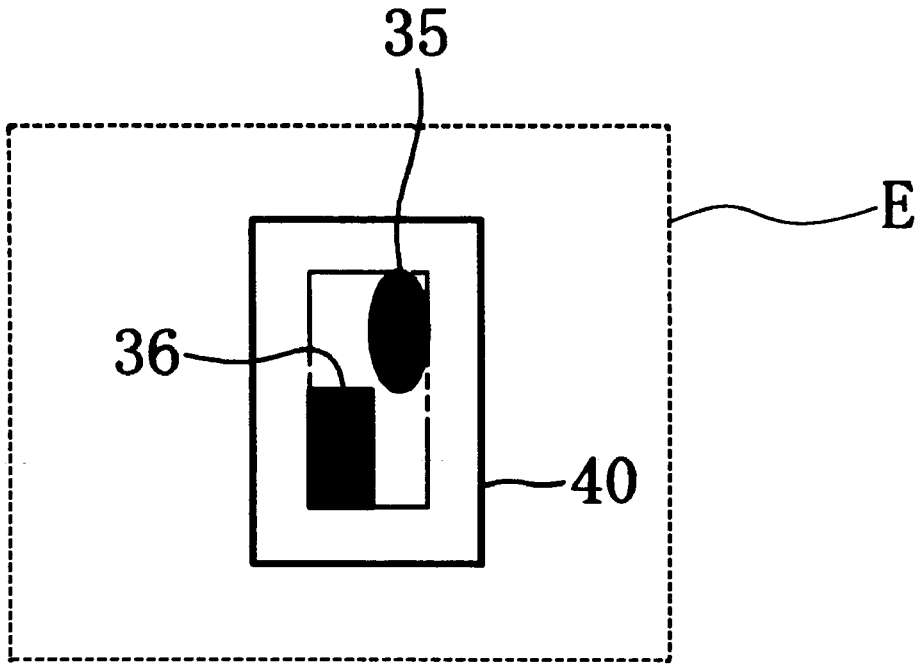
FIG. 26 is a descriptive illustration of temporary stitches forming a rectangular frame when sewing two embroidery patterns.

FIG. 26 describes a case in which an oval 35 and a vertically elongate rectangle 36 are selected as the embroidery patterns to be sewn, and a "□" is further selected as the geometric figure to be temporarily sewn. In such case, first, within the bounds of the rectangular embroiderable area E shown in broken line, a rectangular border shown in double-dot chain line is obtained automatically from the mask data of the two embroidery patterns 35 and 36. Then, the temporary stitch data for a vertically elongate temporary stitch FIG. 40 shown in solid line may be obtained based on the border. The embroiderable area E defines an area allowing execution of embroidery sewing, the size of which is determined by the shape and the size of the embroidery frame WK.

Figure 27:
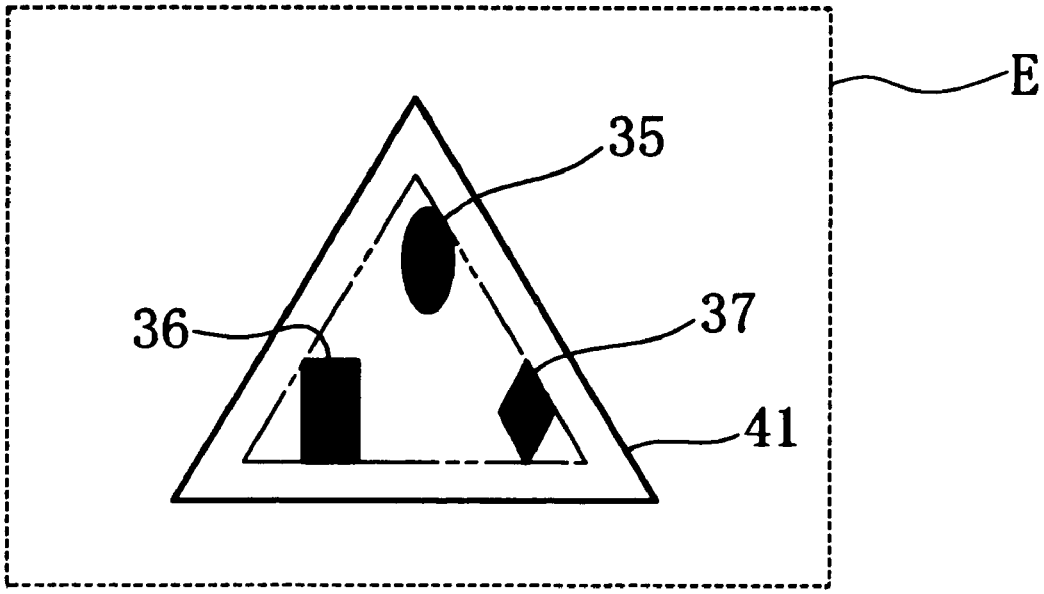
FIG. 27 is a descriptive illustration of temporary stitches forming a triangular frame when sewing three embroidery patterns.

Also, FIG. 27 describes a case in which the oval 35, the vertically elongate rectangle 36, and a vertically oriented rhombus 37 are selected as the embroidery patterns to be sewn and a "Δ" is selected as the geometric figure to be temporarily sewn. In such case, within the bounds of the rectangular embroiderable area E shown in broken line, a triangular border shown in double-dot chain line is initially obtained automatically from the mask data of the three embroidery patterns 35 to 37. Then, the temporary stitch data for a triangular temporary stitch FIG. 41 shown in solid line may be obtained based on the border.

Figure 28:
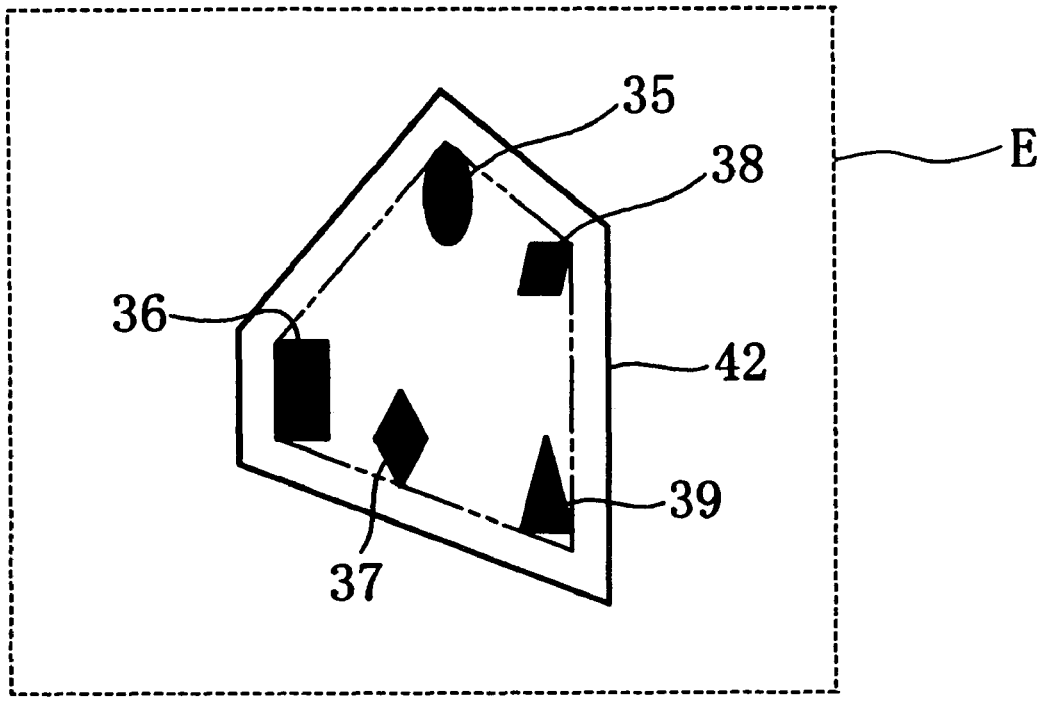
FIG. 28 is a descriptive illustration of temporary stitches forming a pentagonal frame when sewing five embroidery patterns.

Also, FIG. 28 describes a case in which the oval 35, the vertically elongate rectangle 36, the vertically oriented rhombus 37, a diagonally oriented rhombus 38 and a triangle 39 are selected as the embroidery patterns to be sewn, and a "pentagon" is selected as the geometric figure (polygon) for temporary stitching. In such case, within the bounds of the rectangular embroiderable area E shown in broken line, a pentagonal border shown in double-dot chain line is initially obtained automatically from the mask data of the five embroidery patterns 35 to 39. Then, the temporary stitch data for a pentagonal temporary stitch FIG. 42 shown in solid line may be obtained based on the border.

Figure 29:
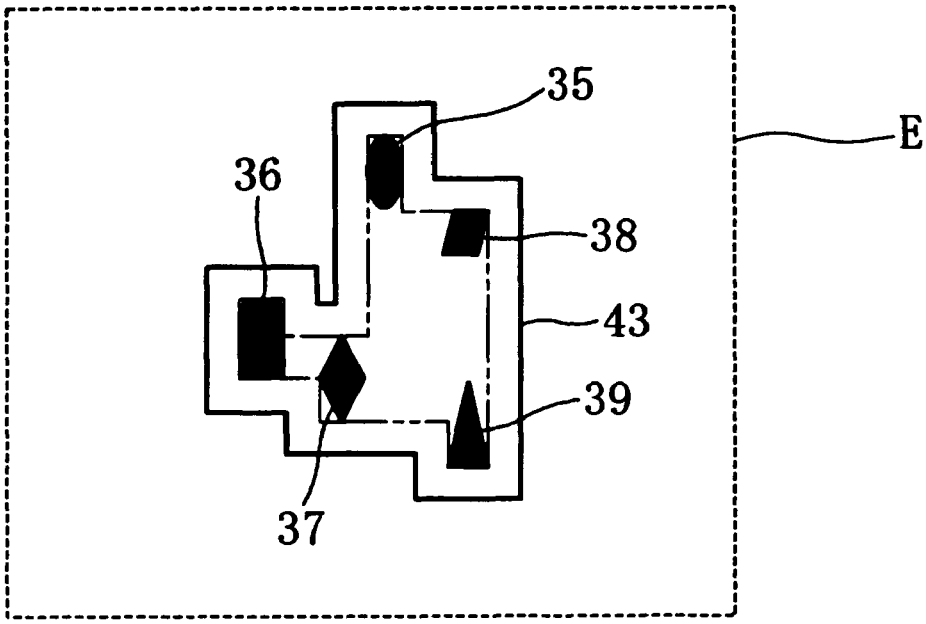
FIG. 29 is a descriptive illustration of temporary stitches when sewing five embroidery patterns.

Also, FIG. 29 describes a case in which the oval 35, the vertically elongate rectangle 36, the vertically oriented rhombus 37, the diagonally oriented rhombus 38 and the triangle 39 are selected as the embroidery patterns to be sewn, and the outline figure key 7*e* is operated as the figure to be temporarily sewn. In such case, within the bounds of the rectangular embroiderable area E shown in broken line, a border shown in double-dot chain line is initially obtained automatically from the five mask data of the embroidery patterns. Then, the temporary stitch data for a temporary stitch FIG. 43 shown in solid line may be obtained based on the border.

Figure 30:
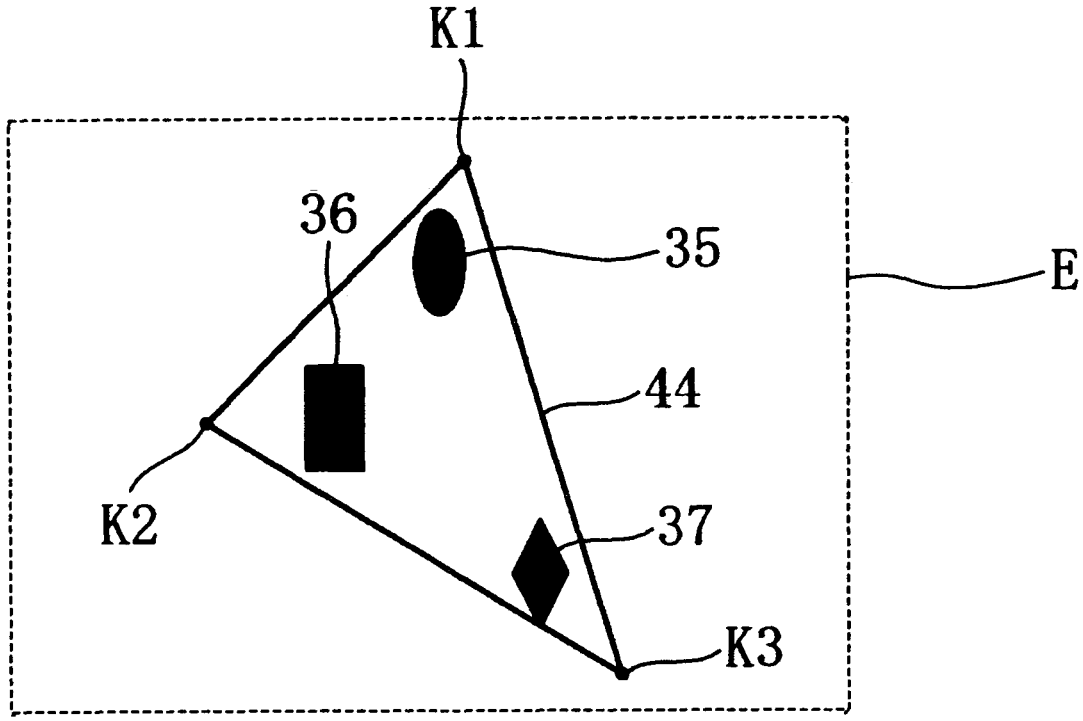
FIG. 30 is a descriptive illustration of temporary stitches forming a triangular frame when sewing three embroidery patterns.

Also, FIG. 30 describes a case in which the oval 35, the vertically elongate rectangle 36, and the vertically oriented rhombus 37 are selected as the embroidery patterns to be sewn and the user has plotted three corner points K1 to K3 in the listed sequence. In such case, the temporary stitch data for a triangular FIG. 44 shown in solid line may be obtained based on the corner points K1 to K3.

The foregoing description and drawings are merely illustrative of the principles of the present disclosure and are not to be construed in a limited sense. Various changes and modifications will become apparent to those of ordinary skill in the art. All such changes and modifications are seen to fall within the scope of the disclosure as defined by the appended claims.

What is claimed is:

1. An embroidery data processor comprising:

an embroidery data preparator that prepares embroidery data for sewing an embroidery pattern by an embroiderable sewing machine, the embroidery pattern having an outer boundary contour; and a data generator that generates a plurality of temporary stitch data for temporarily sewing an interlining on an underside of a workpiece cloth prior to embroidery sewing based on the embroidery data prepared by the embroidery data preparator, the plurality of temporary stitch data lying outwardly from and substantially surrounding the outer boundary contour corresponding to an outer periphery of the embroidery pattern by a predetermined spacing.

2. The embroidery data processor of claim 1, wherein the data generator includes an automatic data generator that automatically generates the temporary stitch data based on the embroidery data prepared by the embroidery data preparator.

3. The embroidery data processor of claim 2, wherein the automatic data generator includes a first automatic generator that obtains a first outline corresponding to the outer boundary contour of the embroidery pattern based on the embroidery data and that generates a second outline outwardly expanded by the predetermined spacing from the first outline to generate the temporary stitch data for forming temporary stitches along the second outline.

4. The embroidery data processor of claim 2, wherein the automatic data generator includes a figure selector that allows selection of a geometric figure to correspond to the embroidery pattern, and a second automatic generator that generates temporary stitch data of the geometric figure selected by the figure selector and that frames the embroidery pattern.

5. The embroidery data processor of claim 1, wherein the data generator includes a figure selector that allows selection of a geometric figure to correspond to the embroidery pattern, a figure specifier allowing manual specification of the geometric figure selected by the figure selector and framing the embroidery pattern, and a third automatic generator that generates temporary stitch data of the geometric figure specified by the figure specifier.

6. The embroidery data processor of claim 1, wherein the data preparator prepares one or a plurality of embroidery data.

7. A sewing machine comprising:

an embroidery data preparator that prepares embroidery data for sewing an embroidery pattern by the sewing machine, the embroidery pattern having an outer boundary contour; and a data generator that generates a plurality of temporary stitch data for temporarily sewing an interlining on an underside of a workpiece cloth prior to embroidery sewing based on the embroidery data prepared by the embroidery data preparator, the plurality of temporary stitch data lying outwardly from and substantially surrounding the outer boundary contour corresponding to an outer periphery of the embroidery pattern by a predetermined spacing.

8. The sewing machine of claim 7, wherein the data generator includes an automatic data generator that automatically generates the temporary stitch data based on the embroidery data prepared by the embroidery data preparator.

9. The sewing machine of claim 8, wherein the automatic generator includes a first automatic generator that obtains a first outline corresponding to the outer boundary contour of the embroidery pattern based on the embroidery data and that generates a second outline outwardly expanded by the predetermined spacing from the first outline to generate the temporary stitch data for forming temporary stitches along the second outline.

10. The sewing machine of claim 8, wherein the automatic data generator includes a figure selector that allows selection of a geometric figure to correspond to the embroidery pattern and a second automatic generator that generates temporary stitch data of the geometric figure selected by the figure selector and that frames the embroidery pattern.

11. The sewing machine of claim 7, wherein the data generator includes a figure selector that allows selection of a geometric figure to correspond to the embroidery pattern, a figure specifier allowing manual specification of the geometric figure selected by the figure selector and framing the embroidery pattern, and a third automatic generator that generates temporary stitch data of the geometric figure specified by the figure specifier.

12. The sewing machine of claim 7, wherein the data preparator prepares one or a plurality of embroidery data.

13. A non-transit computer readable medium for embroidery data processing having a computer program embedded thereon, the computer program comprising:

an embroidery data preparing routine of preparing embroidery data of an embroidery pattern to be sewn by an embroiderable sewing machine, the embroidery pattern having an outer boundary contour; and;

a data generating routine of generating a plurality of temporary stitch data for temporarily sewing an interlining on an underside of a workpiece cloth prior to embroidery sewing based on the embroidery data prepared by the embroidery data preparing routine, the plurality of temporary stitch data lying outwardly from and substantially surrounding the outer boundary contour corresponding to an outer periphery of the embroidery pattern by a predetermined spacing.

14. The computer readable medium of claim 13, wherein the data generating routine includes an automatic data generating routine of automatically generating the temporary stitch data based on the embroidery data prepared by the embroidery data preparing routine.

15. The computer readable medium of claim 14, wherein the automatic generating routine includes a first automatic generating routine of obtaining a first outline corresponding to the outer boundary contour of the embroidery pattern based on the embroidery data and generating a second outline outwardly expanded by the predetermined spacing from the first outline to generate the temporary stitch data for forming temporary stitches along the second outline.

16. The computer readable medium of claim 14, wherein the automatic data generating routine includes a figure selecting routine of allowing selection of a geometric figure to correspond to the embroidery pattern, and a second automatic generating routine of generating temporary stitch data of the geometric figure selected by the figure selecting routine and framing the embroidery pattern.

17. The computer readable medium of claim 13, wherein the data generating routine includes a figure selecting routine of allowing selection of a geometric figure to correspond to the embroidery pattern, a figure specifying routine of allowing manual specification of the geometric figure selected by the figure selecting routine and framing the embroidery pattern, and a third automatic generating routine of generating temporary stitch data of the geometric figure specified by the figure specifying routine.

18. The computer readable medium of claim 13, wherein the data preparing routine prepares one or a plurality of embroidery data.

* * * * *